US005937777A

United States Patent [19]

Azima

[11] Patent Number: 5,937,777

[45] Date of Patent: Aug. 17, 1999

[54] MONOHULL WATER-BORNE CRAFT

[75] Inventor: Farad Azima, London, United Kingdom

[73] Assignee: Mission Yachts PLC, London, United Kingdom

[21] Appl. No.: 08/613,659

[22] Filed: Mar. 11, 1996

[30] Foreign Application Priority Data

| | | | |
|---|---|---|---|
| Dec. 16, 1995 | [GB] | United Kingdom | 9525840 |
| Dec. 19, 1995 | [GB] | United Kingdom | 9525937 |
| Jan. 9, 1996 | [GB] | United Kingdom | 9600406 |

[51] Int. Cl.[6] ..... B63B 1/00

[52] U.S. Cl. ..... 114/61.11; 114/123

[58] Field of Search ..... 114/61, 123, 271, 114/274, 162, 126, 140, 125, 141, 121, 142

[56] References Cited

U.S. PATENT DOCUMENTS

| | | | |
|---|---|---|---|
| 2,544,599 | 3/1951 | Keelen . | |
| 2,991,746 | 7/1961 | Cunningham | 114/123 |
| 3,541,987 | 11/1970 | Barkley . | |
| 3,623,444 | 11/1971 | Lang | 114/61 |
| 3,702,106 | 11/1972 | Wilder . | |
| 4,348,972 | 9/1982 | Parsons . | |
| 4,441,445 | 4/1984 | DeWeck | 114/123 |
| 5,163,377 | 11/1992 | Calderon et al. . | |
| 5,199,367 | 4/1993 | Horiuchi et al. . | |
| 5,529,009 | 6/1996 | Faury et al. | 114/123 |

FOREIGN PATENT DOCUMENTS

| | | |
|---|---|---|
| 0 455 605 | 11/1991 | European Pat. Off. . |
| 0 568 501 | 11/1993 | European Pat. Off. . |
| 4338333A1 | 5/1995 | Germany . |
| 58-174080 | 10/1983 | Japan . |
| 183583 | 4/1936 | Switzerland . |
| 2067148 | 7/1981 | United Kingdom . |
| 2219973 | 6/1988 | United Kingdom . |
| WO 8902390 | 3/1989 | WIPO . |
| WO 94/20359 | 9/1994 | WIPO . |

*Primary Examiner*—Stephen Avila

*Attorney, Agent, or Firm*—Gary M. Nath; Nath & Associates

[57] ABSTRACT

The invention is a monohull water-borne craft comprising a hull having a main portion and an opposed pair of stabilizers, the stabilizers being positioned on opposite sides of the main hull portion and being disposed closely adjacent to the main hull portion. The stabilizers may be elongate and arranged with their long axes extending along the main hull portion to form pods. The stabilizers may be integral with the main hull portion or may be movable, e.g. to enable variable geometry to give active buoyancy and/or ballast and/or assistance in steering or stability. The stabilizers may carry propulsion means, fuel tanks, active ballast tanks or the like. The stabilizers may thus be single function e.g. to provide buoyancy, ballast or to house equipment such as propulsion means or may be multifunctional to combine one or more of such functions. The craft may be a power boat or a sail craft and may be convertible between power and sail. The stabilizers may be housed, at least partly, within cavities in the main hull portion.

47 Claims, 18 Drawing Sheets

1
10
8
29
30
V'
V''

MONOHULL WATER-BORNE CRAFT

DESCRIPTION

The invention relates to water-borne craft, more particularly, but not exclusively, of the nature of pleasure craft such as yachts and power boats.

Known single hull, i.e. monohull, sail craft require a substantial keel to maintain stability during sailing. Especially with larger yachts the keel must be substantial in terms of both weight and size that is to say in a range between 25% and 75%, and typically 40%, of the total weight of the boat. For this and other reasons such a sail craft when operated under motor power cannot compete in terms of performance with a conventional power boat. Nevertheless such monohull craft have popular appeal. Conversely a conventional power boat is incapable of operation as a high performance sail yacht due to the lack of a large ballast keel.

Multi-hull sail craft are known and which obviate the need for the large and/or heavy keel of a conventional monohull yacht. The stability of a multi-hull craft is inherently good compared to that of a monohull craft, although once capsized a monohull craft is usually easier to right than is a multi-hull craft.

Multi-hull sail craft can employ hulls which are narrow in beam in relation to their length which provides a performance gain but such craft are not without their own specific operational disadvantages. Thus catamarans achieve their stability by utilising a spaced pair of hulls. The hulls are conventionally narrow in beam in relation to their length to reduce hydrodynamic drag but the result is that the useful accommodation space in the hulls is somewhat compromised. At least where motor cruising catamarans are concerned this accommodation problem can be met by decking and superstructure between the hulls above the waterline, since compared to a sail boat, the problems of raised centre of gravity are less acute. Nevertheless it is also known to provide a sailing catamaran with a superstructure, but this will tend to raise the centre of gravity of the craft and can give rise to functional difficulties, e.g. reducing available space, reducing practicality as well as diminishing the aesthetics of the craft.

The problem of useful accommodation space is not so acute in a trimaran hull configuration, but here the compromise results in a craft with a pair of substantially sized stabilizing members, i.e. outrigger hulls, laterally spaced by a considerable distance from a central main hull which means that such a craft is wide in beam and is cumbersome in confined spaces, e.g. when manoeuvring in a marina. It is thus known to provide a trimaran having folding outriggers to assist in berthing. Also the dynamic stability of a trimaran may, when its outriggers are alternately wetted when the boat is in motion, lead to a variety of undesirable effects in use.

It is also known to provide a hydrofoil sailing craft in which the hydrofoils are arranged in a triangle. The advantage of a hydrofoil craft is to minimise wetted area and thus to improve performance at the expense of passenger comfort and ultimate stability since the craft tends to bounce across the water surface.

It is an object of the invention to bring at least some of the benefits of a multi-hull water-borne craft to a monohull water-borne craft.

It is another object of the present invention to provide a water-borne craft which is capable of operation both as a sail yacht and as a power boat.

From one aspect the invention is a monohull water-borne craft comprising a hull having a main portion and an opposed pair of buoyant stabilizers, the stabilizers being positioned on opposite sides of the main hull portion and being disposed closely adjacent to the main hull portion. The stabilizers may be elongate and arranged with their long axes extending along the main hull portion. The stabilizers may be integral with the main hull portion over a substantial portion of their lengths.

From a further aspect the invention is a monohull water-borne craft comprising a hull having a main portion and an opposed pair of stabilizing pods extending laterally from opposite sides of the main hull portion and closely coupled to the main hull portion, the arrangement being such that the pods provide stability by way of buoyancy.

From another aspect the invention is a monohull water-borne craft comprising a hull having a main portion and an opposed pair of stabilizing pods extending laterally from opposite sides of the main hull portion and closely coupled to the main hull portion, the arrangement being such that the pods provide stability by way of ballast disposed remote from the centre line of the main hull portion.

From yet another aspect the invention is a monohull water-borne craft comprising a hull having a main portion and an opposed pair of stabilizing pods extending laterally from opposite sides of the main hull portion and closely coupled to the main hull portion, the arrangement being such that the pods provide stability both by way of buoyancy and by way of ballast disposed remote from the centre line of the main hull portion.

The craft may be at least substantially without a ballast keel. The craft may be convertible for use as a sail craft and as a power boat.

From another aspect the invention is a monohull water-borne craft comprising a hull having a main portion and an opposed pair of stabilizing pods extending laterally from opposite sides of the main hull portion and closely coupled to the main hull portion, each of the pods housing propulsion means. The craft may be at least substantially without a ballast keel. The pods may provide stability by way of buoyancy and/or by way of ballast positioned remote from the centre line of the main hull portion. The craft may be convertible for use as a sail craft and as a power boat.

From a further aspect, the invention is a convertible monohull water-borne craft adapted for use as a sail craft and as a power craft and comprising a hull having a main portion and an opposed pair of stabilizing pods extending laterally from opposite sides of the main hull portion and closely coupled to the main hull portion, and propulsion means disposed in each of the pods, the craft being at least substantially without a ballast keel.

From yet another aspect the invention is a monohull water-borne craft comprising;

- a hull having a main portion which comprises a bow portion, a stern portion and opposite sides defining a pair of beam extremities,
- an opposed pair of elongate stabilizers extending along the said opposite sides of the main hull portion, and
- a pair of propulsion means one of which is housed near to one of the said beam extremities and the other of which is housed near to the other said beam extremity. The craft may be least substantially without a ballast keel as herein defined. The stabilizers may be buoyant and/or ballasted. The stabilizers may extend downwards below the main hull portion. The craft may be a sail craft. The pair of propulsion means may be hydrojet propulsion means housed in the respective stabilizers. A retractable keel may be associated with each stabilizer. The craft may comprise means for moving the stabilizers relative to the main hull portion and relative to one another. The stabilizers may be at least partly housed in one or more cavities in the main hull portion.

In the present invention a craft which is at least substantially without a ballast keel is one in which the ballast keel represents less than 25% of the total weight of the boat.

In the present invention, the stabilizers or pods are small in internal volume in relation to the internal volume of the main hull portion. Thus they may each have an internal volume in a range up to 15%, and preferably around 10%, of the internal volume of the main hull portion, excluding its superstructure. In any case the internal volume of each pod will not exceed 25% of the internal hull volume.

In the present invention, the stabilizers or pods may be integral with the main hull portion, or may be movable relative to the main hull portion. The stabilizers may be movable from positions in which they extend laterally from the opposite sides of the main hull portion to positions in which they lie substantially flush with the main hull portion. The pods may be movable up and down, and/or laterally to vary the geometry of the craft. The pods may be pivotally mounted on the main hull portion. Alternatively the pods may be telescopically extendible. In this case it may be desirable to extend the pods in a generally fore and aft direction from a wide portion of the beam of the main hull portion so that the pods extend along the sides of the craft. Power means, e.g. hydraulic or mechanical means, may be provided for moving the pods between their different positions. Alternatively the pods may be inflatable. The pods may be independently, i.e. differentially, movable.

Two or more stabilizers may be provided on each side of the main hull portion.

The uses provided by the pods may thus be single or multi-functional and may fall into one or more of the following categories, namely:

(1) hydrodynamic, e.g. in the nature of bilge keels or static or differentially movable stabilizers, lift producing devices (which may for example lift the main hull from the water in the nature of a hydrofoil) or steering devices;

(2) buoyancy;

(3) ballast;

(4) when the pods are movable together or differentially relative to the main hull portion and are used to house propulsion means, the angling of the pods may be used to produce thrust having a directional component tending to stabilize the craft;

(5) the utility function of housing for heavy and/or bulky components such as engines, generators, electric batteries, water and fuel tanks etc, and (6) the safety functions of separating fuel etc. from the occupants of the craft, providing the possibility of jettisoning fuel or even the pods themselves in an emergency, providing a degree of side impact protection for the hull and providing additional buoyancy in the event of flooding of the main hull.

The external surfaces of the main hull portion and the pods may merge smoothly together. The pods may be narrow in width in relation to their length. The pods may form bulges extending laterally and/or downwardly from each side of the main hull portion.

The pods may form enclosures which are separate from the interior of the main hull portion. The pods may join the main hull portions at their upper portions.

The pods preferably project downwardly from the main hull portion, and the downward projection of the pods may be substantially vertical. Preferably the pods project downwardly to extend below the main hull portion.

The pods may join the main hull portion near to the waterline of the main hull portion. The pods may extend to the deckline of the main hull portion.

The pods may extend along the sides of the main hull portion from a position near to the bow region of the main hull portion to a position near to the stern region of the main hull portion. Alternatively, the pods may extend from the mid region of the main hull portion to a position adjacent to the stern of the main hull portion.

The pods may support or carry rudders and/or fin keels which may be fixed or retractable and which may be ballasted.

The pods may be ballasted with fuel tank(s), water tanks(s), electrical batteries, electrical generators or the like.

Active ballast tanks may be disposed in the pods.

The invention is diagrammatically illustrated, by way of example, in the accompanying drawings, in which.

Figure 14A:
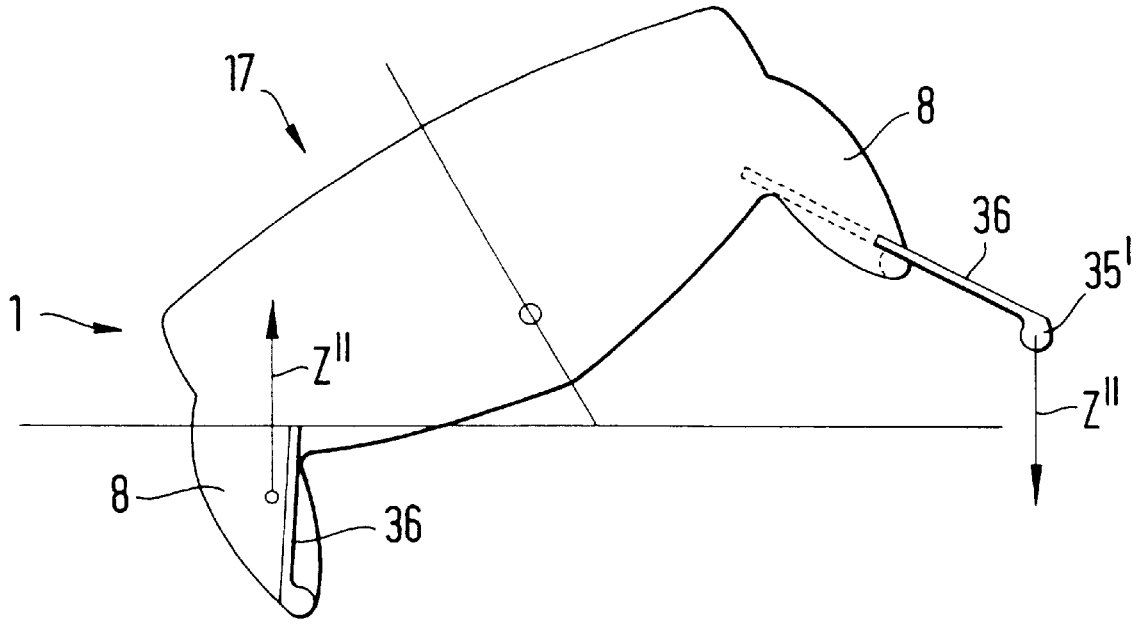
Figure 14B:
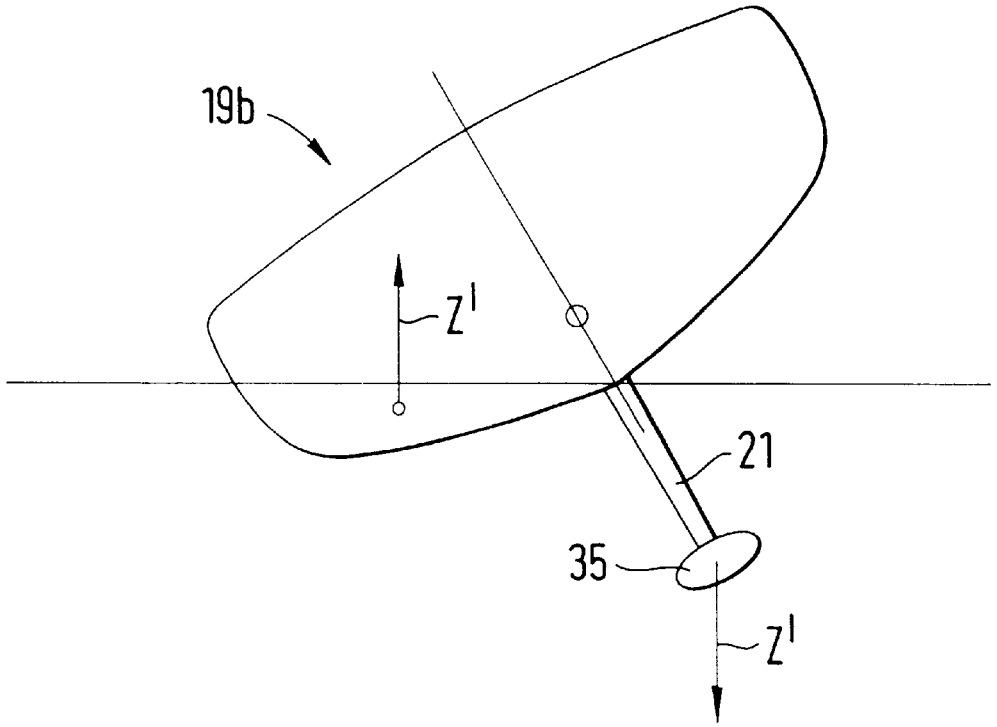
Figure 15:
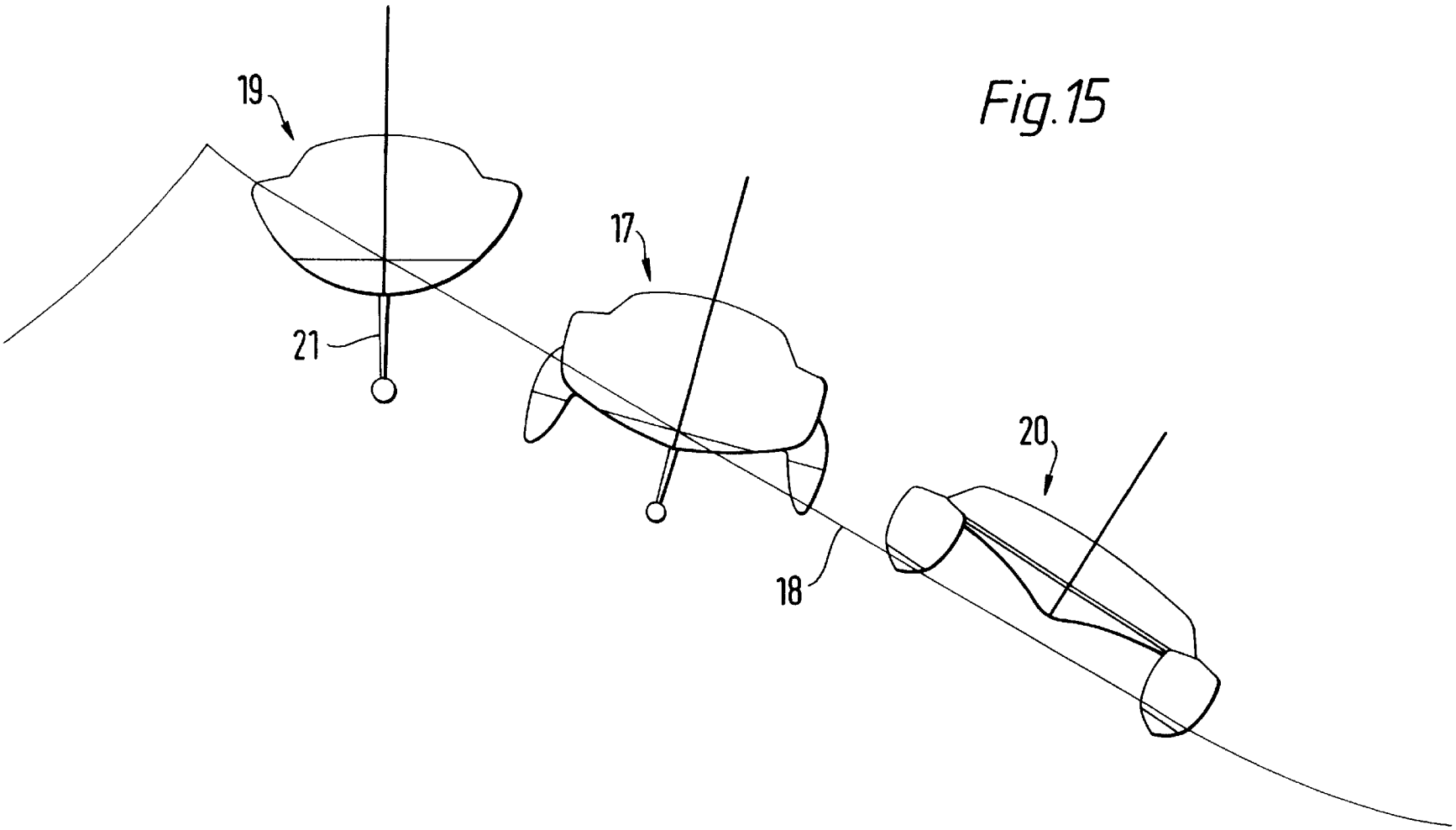
Figure 16A:
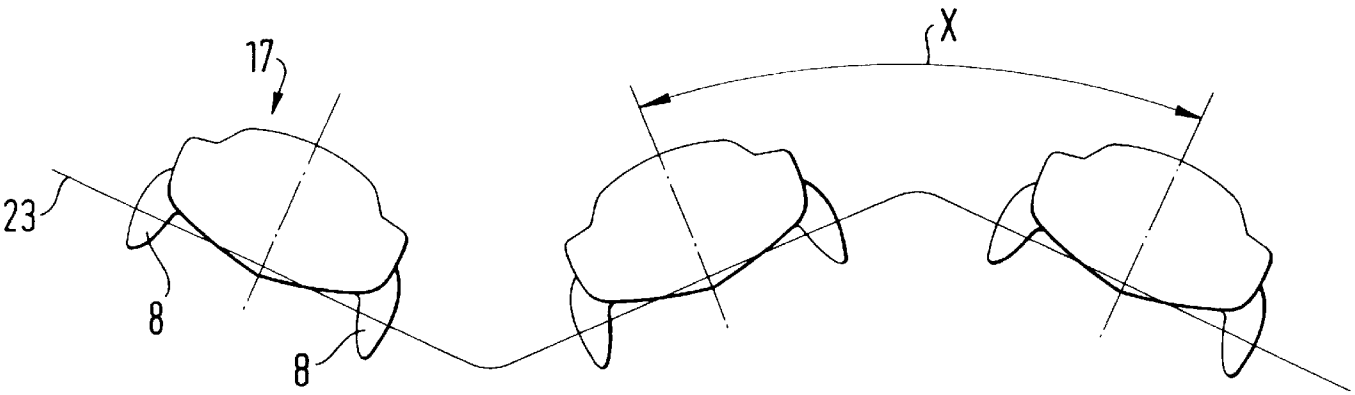
Figure 16B:
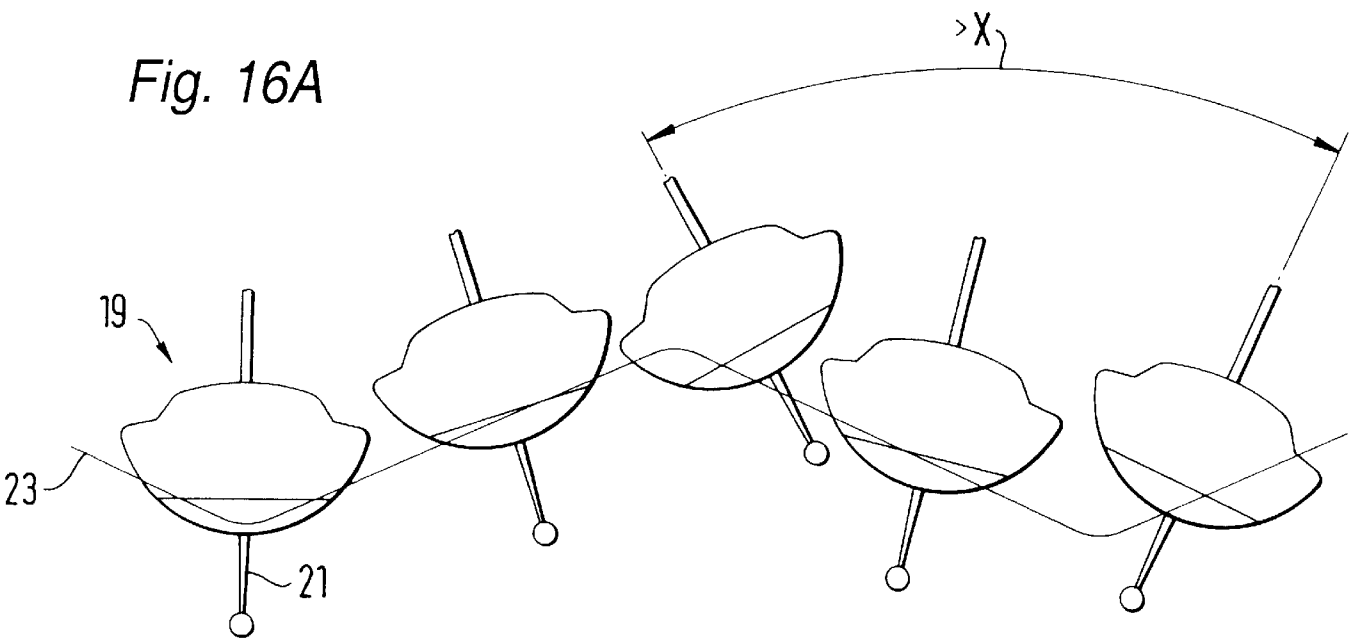
Figure 20:
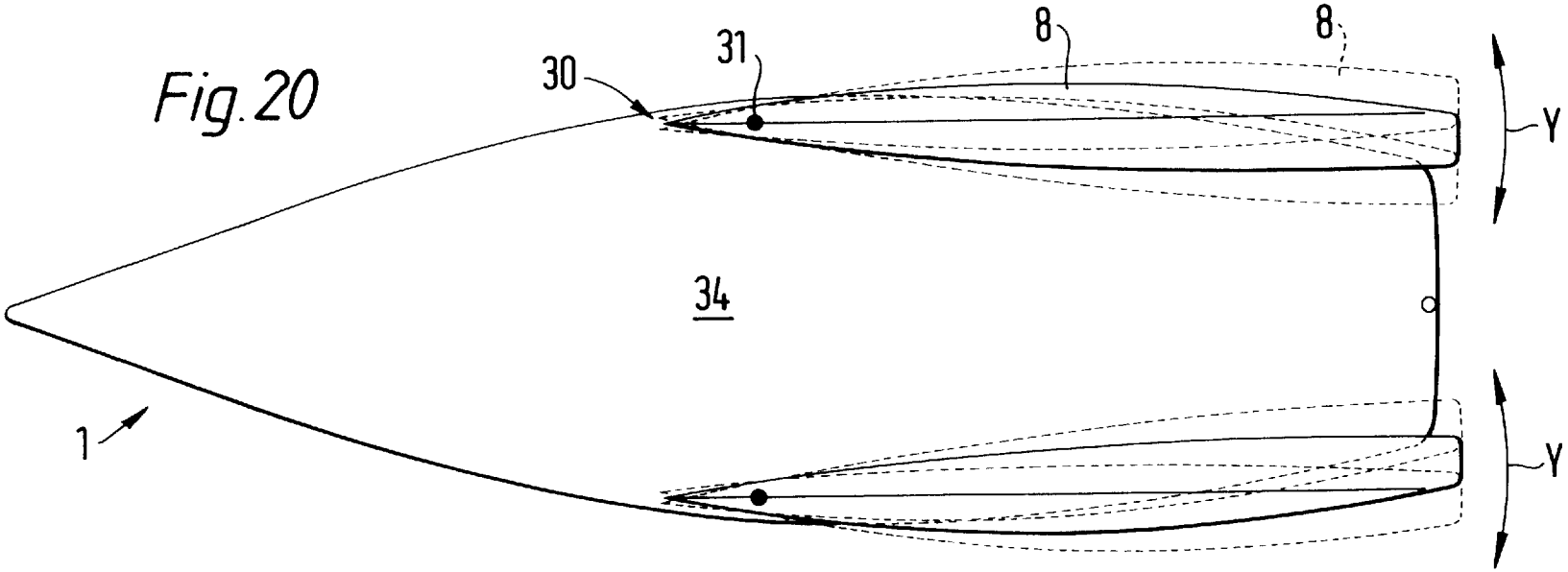
Figure 19:
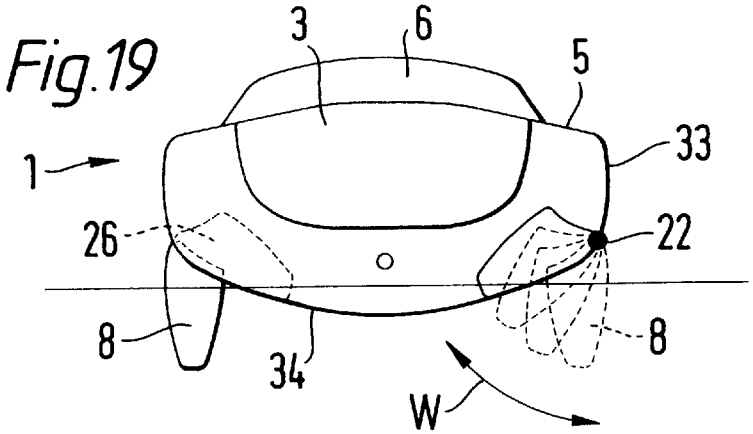
Figures 21, 22, 23:
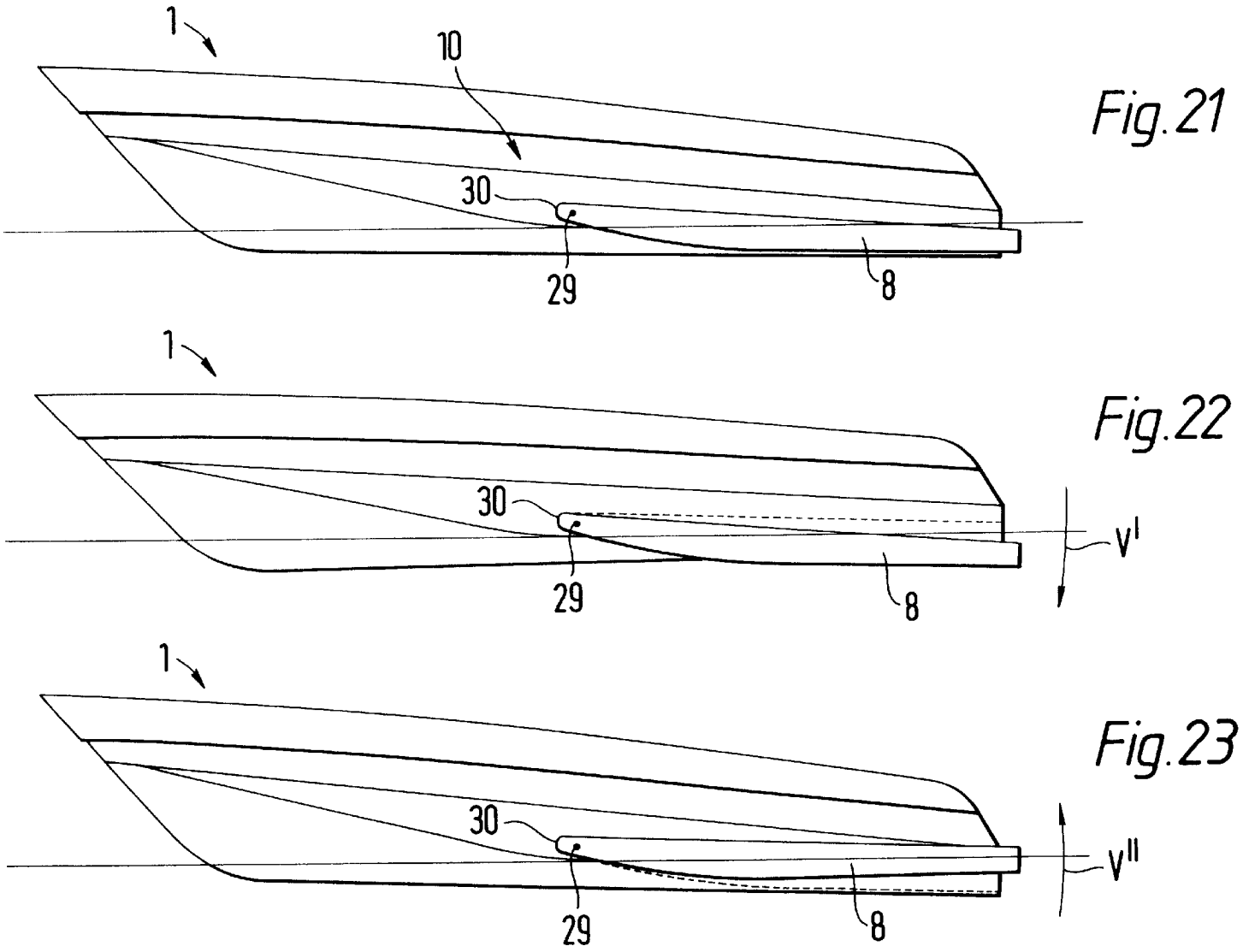
Figure 24:
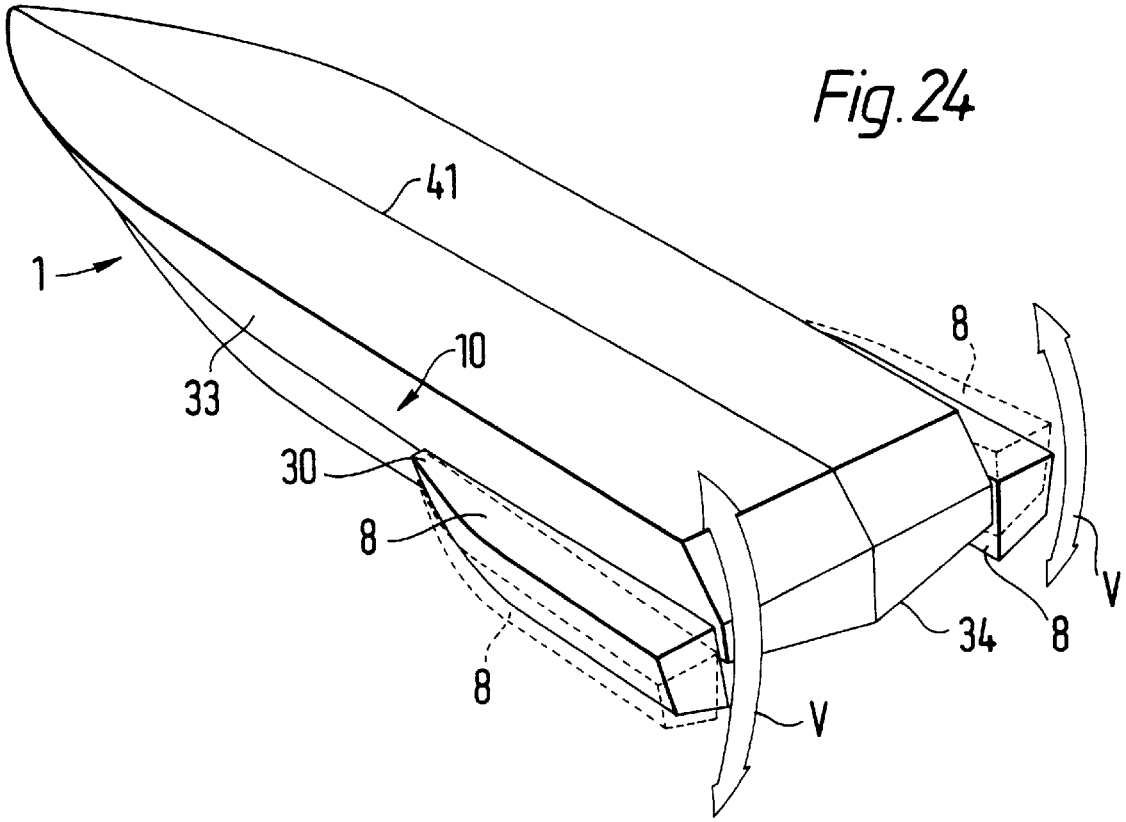
Figure 26:
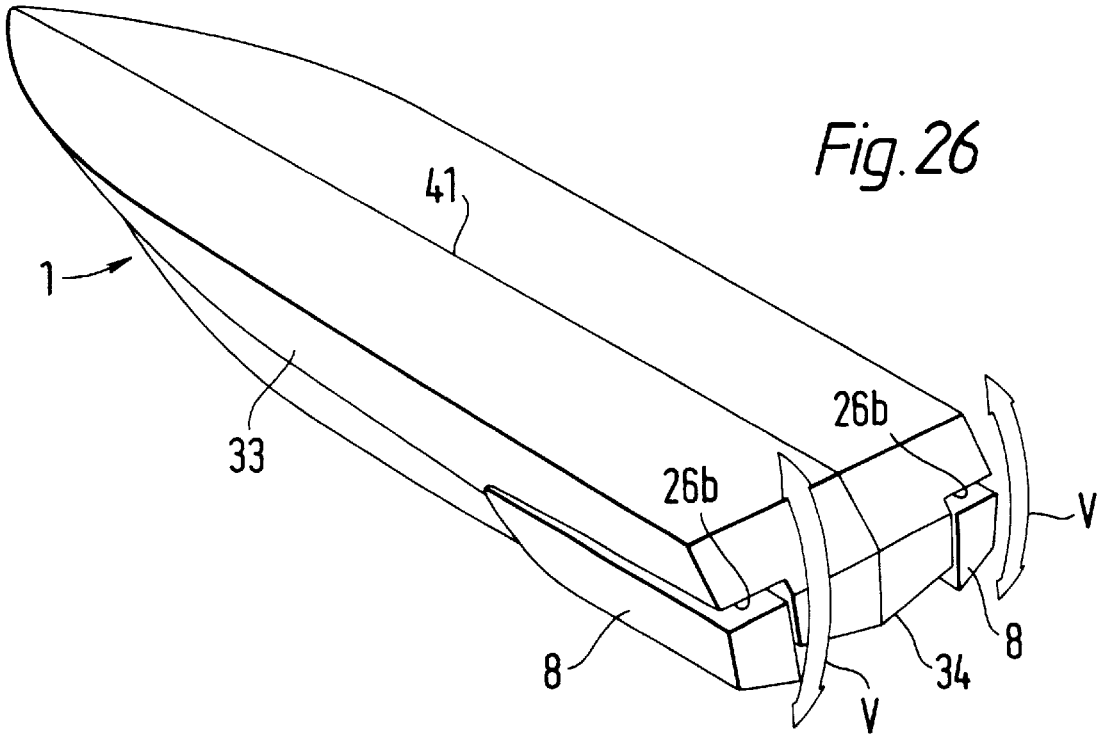
Figure 28:
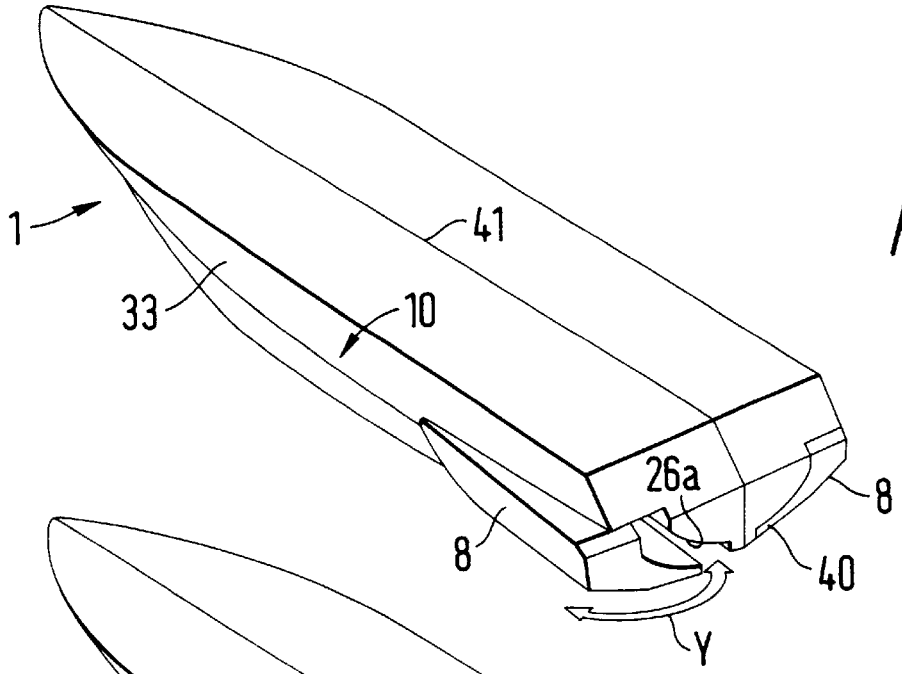
Figure 27:
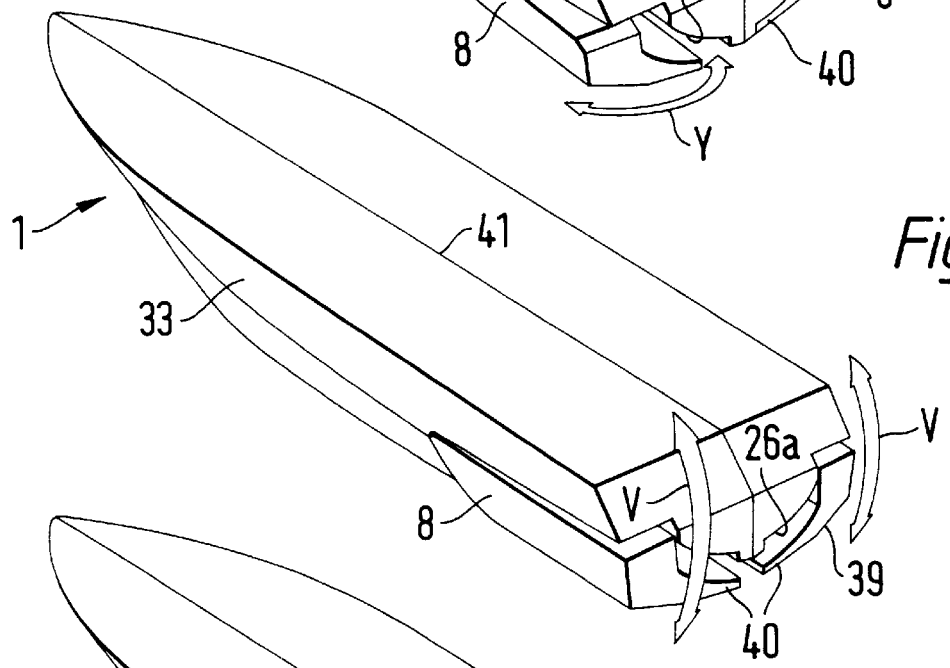
Figure 25:
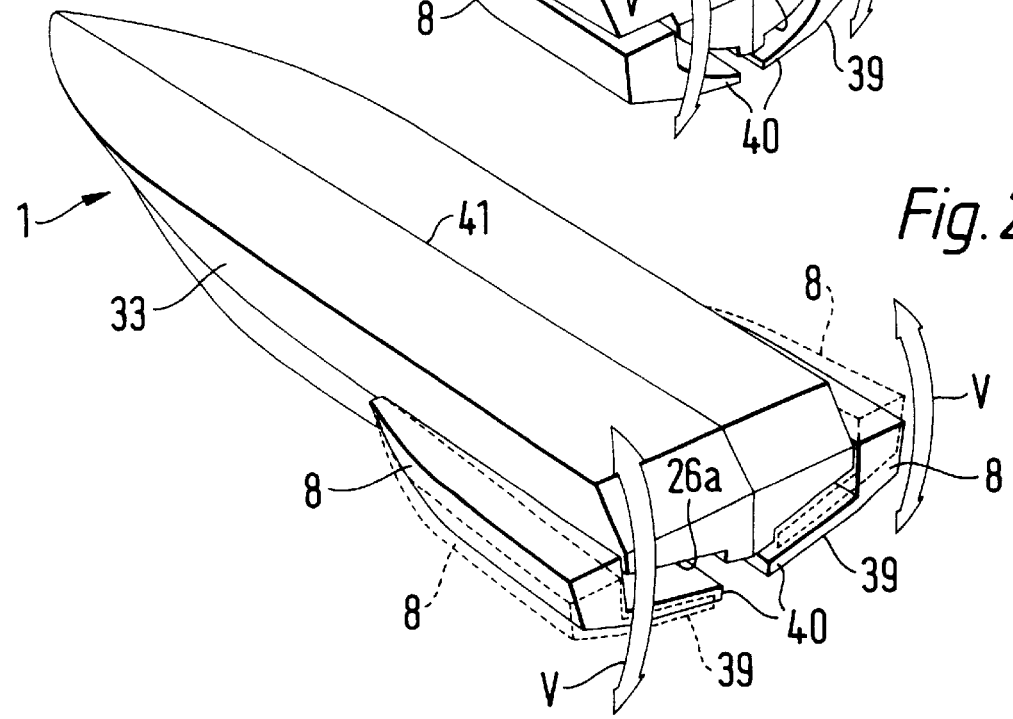
Figure 31:
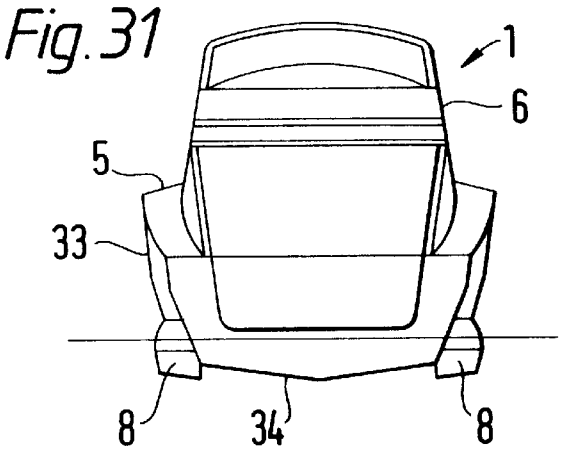
Figure 29:
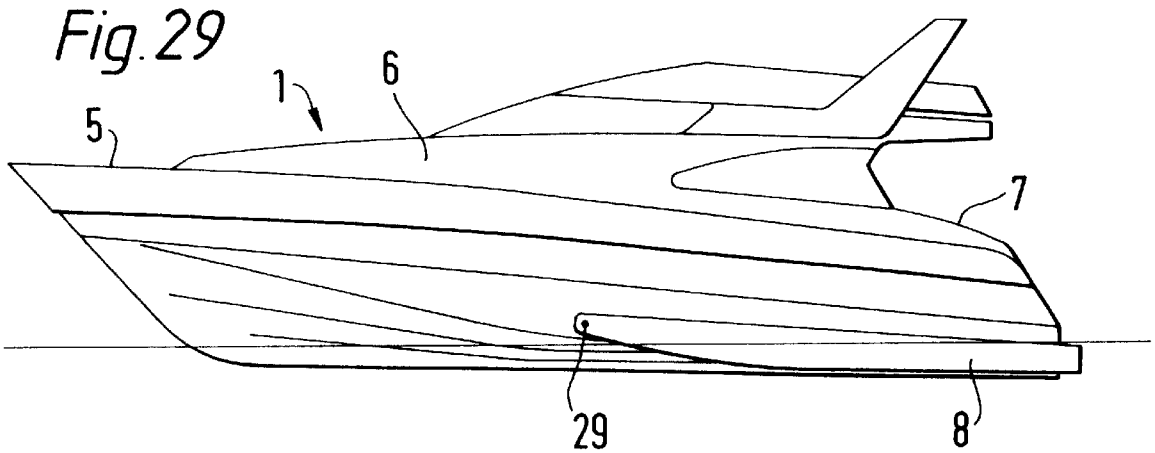
Figure 30:
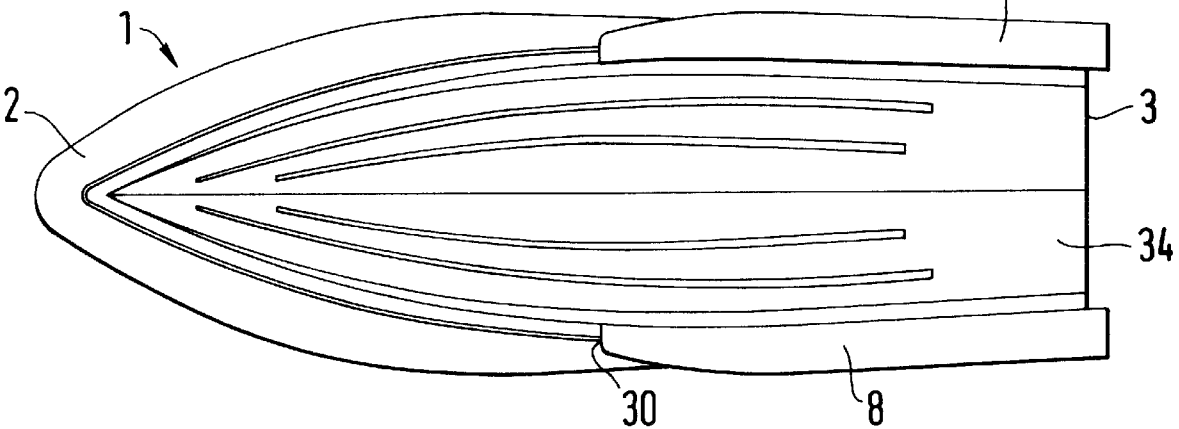

FIG. 14 compares righting forces of a conventional keeled monohull and of a design in accordance with the invention;

FIG. 15 is a diagram comparing the behaviour of known water-borne craft and a craft in accordance with the invention in a large beam sea;

FIG. 16 is a diagram comparing the roll behaviour of known water-borne craft and a craft in accordance with the invention in a short side sea under static conditions, e.g. in harbour;

FIG. 17 is a diagram showing the hull outlines and immersed intersections in plan of an embodiment of a craft according to the invention, a conventional monohull, a catamaran and a trimaran respectively;

FIG. 18 is a diagram showing the hull outline and immersed intersections in plan of the embodiment of craft of the invention of FIG. 17 under different conditions;

FIG. 19 is an end view of an embodiment of craft in accordance with the invention and having movable pods;

FIG. 20 is an underneath plan view of another embodiment of craft in accordance with the invention and having movable pods;

FIGS. 21 to 23 are respective side views of an embodiment of power boat according to the invention and which show how the pods can be moved to alter the trim of the craft;

FIG. 24 is a perspective view of the embodiment of power boat shown in FIGS. 21 to 23;

FIG. 25 is a perspective view of a modified form of the embodiment of power boat shown in FIG. 24;

FIG. 26 is a perspective view of a further modified version of the power boat of FIGS. 21 to 23;

FIGS. 27 and 28 are perspective views of further modified forms of the embodiment of power boat shown in FIG. 26;

FIGS. 29 to 31 are respectively a side view, an underneath plan view and a rear view of a power boat incorporating the movable pods of the embodiment shown in FIGS. 21 to 23, and FIGS. 32 to 34 show a modified form of the power boat of FIG. 26.

In the drawings there is shown a monohull water-borne craft which may be a sail craft, a power boat or a convertible sail boat/power boat. The craft has a main hull portion which is generally conventional in form except for being substantially without, in the case of a sail boat, a conventional large ballast keel and which main hull portion is formed with an opposed pair of close-coupled stabilizing pods, extending laterally and/or downwardly from opposite sides of the hull. In the embodiments of FIGS. 1 to 12 the pods are formed integrally with the hull. However, in the embodiments of FIGS. 19 to 34 it will be seen that the stabilizing pods are movable, for the reasons appearing more fully below.

Figure 1:
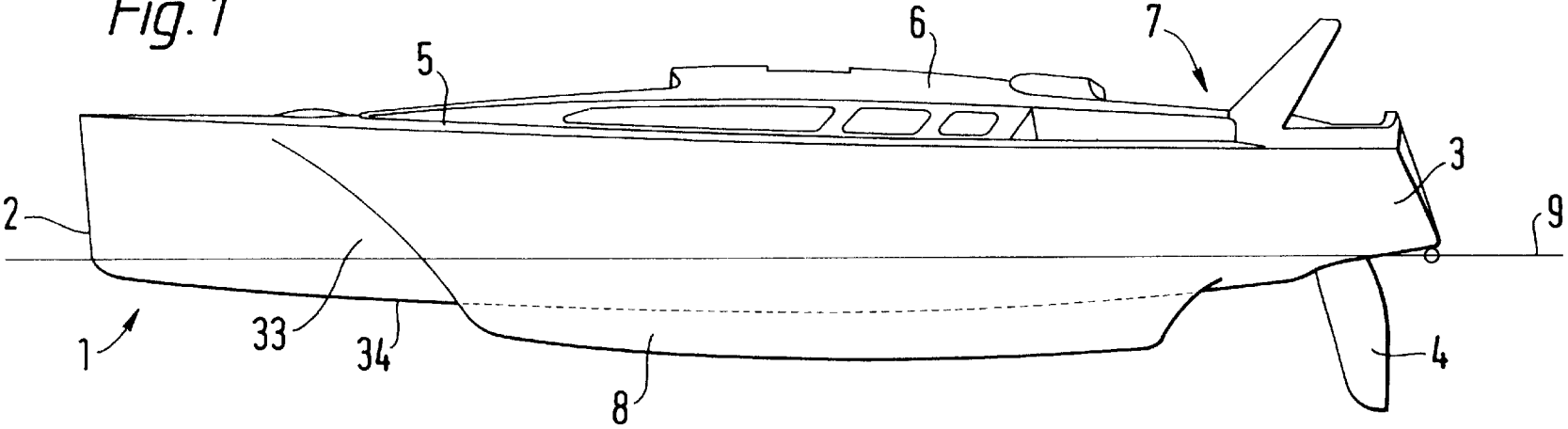
FIG. 1 is a side view of a sail craft in accordance with the invention.
Figure 2:
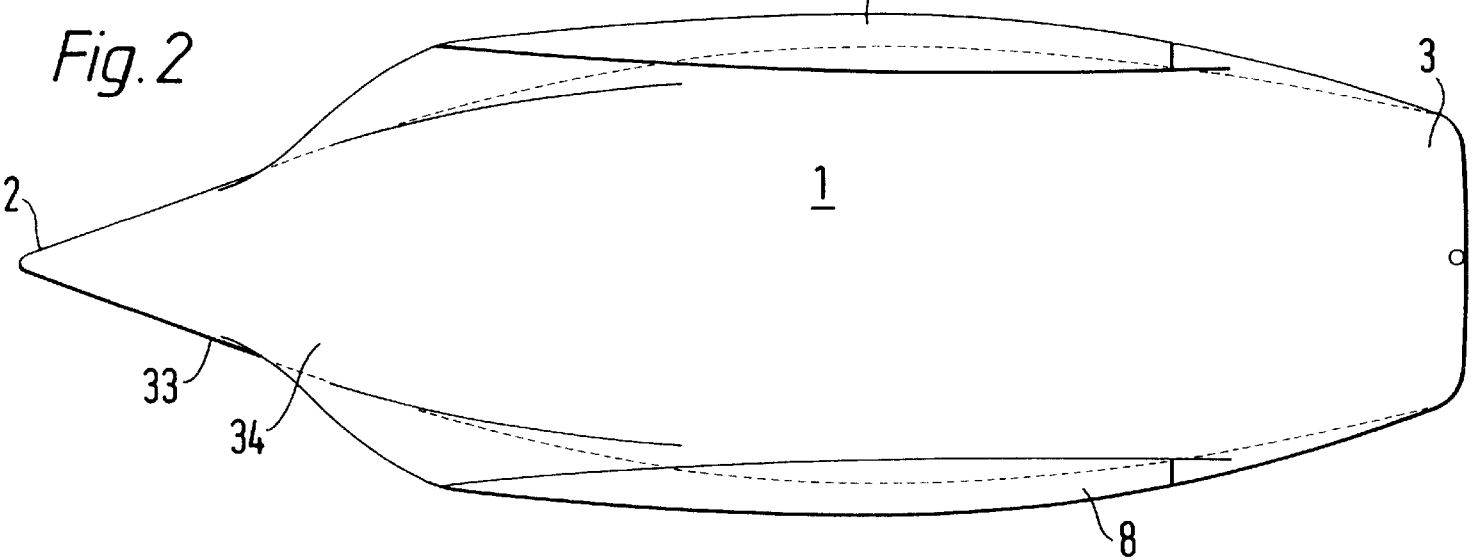
FIG. 2 is an underneath plan view of the craft of FIG. 1.
Figure 3:
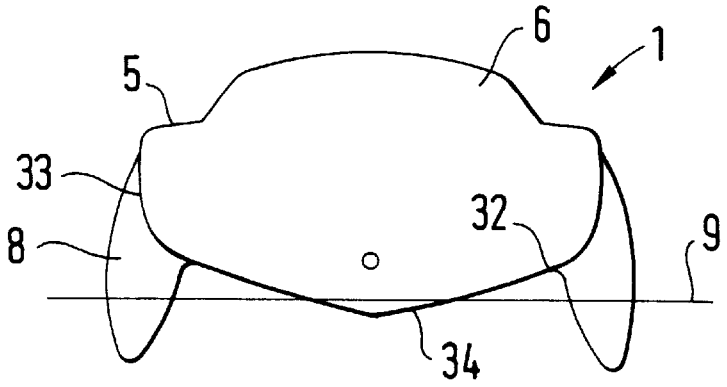
FIG. 3 is an end view of the craft of FIG. 1.

In FIGS. 1 to 3 there is shown a monohull pleasure craft convertible for use as a sail boat and as a power boat and having a main hull portion 1 having a bow 2, a stern 3, sides 33 and a bottom or underside 34. A steering rudder 4 is disposed at the stern 3. The craft has a deck 5 and a superstructure 6 and rear cockpit 7. The craft is also provided with a mast and sails (not shown) in conventional manner.

The opposite sides 33 of the hull 1 are formed with a pair of laterally extending stabilizing pods 8 which are integral with the hull 1 and which extend lengthwise of the main hull from a position immediately behind the bow region 2 to a position immediately ahead of the stern region 3. The pods 8 merge smoothly with the surface of the hull to form bulges from the sides of the main hull 1 to increase the beam of the craft and extending from the deck level 5 and projecting substantially vertically downwardly and returning upwardly to extend above the waterline 9 before rejoining the underside of the main hull at a position 32. The main hull may be formed with devices or means for increasing lateral resistance to improve windward performance, e.g. a fin keel, centre board, centre plate, power thruster or the like (not shown). Alternatively or additionally such devices or means, e.g. fixed or retractable fin keels, dagger or lee boards or blades may be provided on the pods 8 to increase lateral resistance. Such devices, if retractable, may be made differentially retractable e.g. as an aid to steering, stability, performance and/or to provide active ballast, see FIG. 14.

The pods 8 are buoyant to increase the stability of the craft. Propulsion units and their associated fuel tanks, along with other heavy equipment such as electrical batteries, generators and water tanks can be accommodated in the pods so that they do not occupy or intrude into the usable accommodation space in the main hull and so that the propulsion units etc. provide optimally distributed ballast positioned remote from the centre line of the craft, i.e. at or near to the beam extremities, to increase inertia about the longitudinal axis of the craft and thereby reduce roll angle. Also noise and smell associated with engines may be reduced by disposing the propulsion units etc. in the pods. The propulsion units may be coupled to drive propellers but they may be in the form of water jet propulsion units, i.e. hydrojets.

The interiors of the pods 8 are preferably physically separate from the interior of the main hull portion, although they may be connected if desired e.g. by water-tight doors, not shown.

The craft may have both pods in the water when static although during normal operation one or other pod may be clear of the water, e.g. when the boat is heeled over. It is also intended that the craft may operate in displacement, semi-displacement and/or planing modes.

Figure 6:
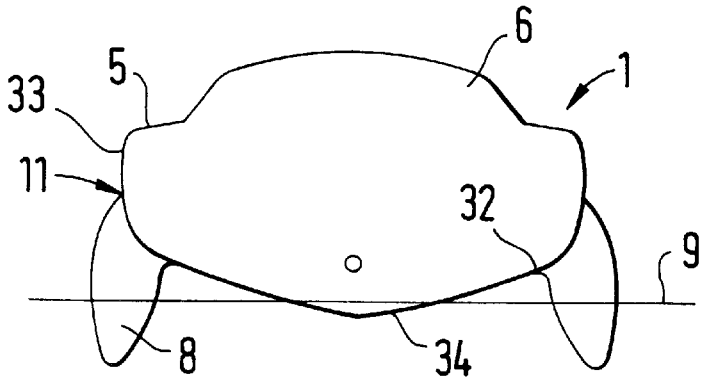
FIGS. 4 to 6 are generally similar to FIGS. 1 to 3 respectively and show a second embodiment of the invention.
Figure 4:
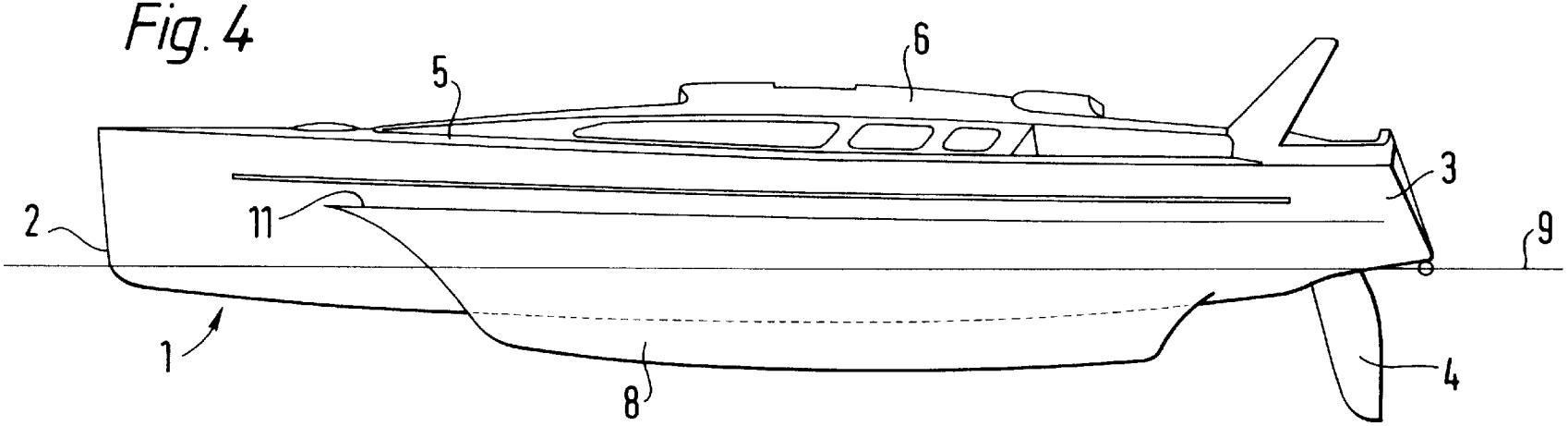
Figure 5:
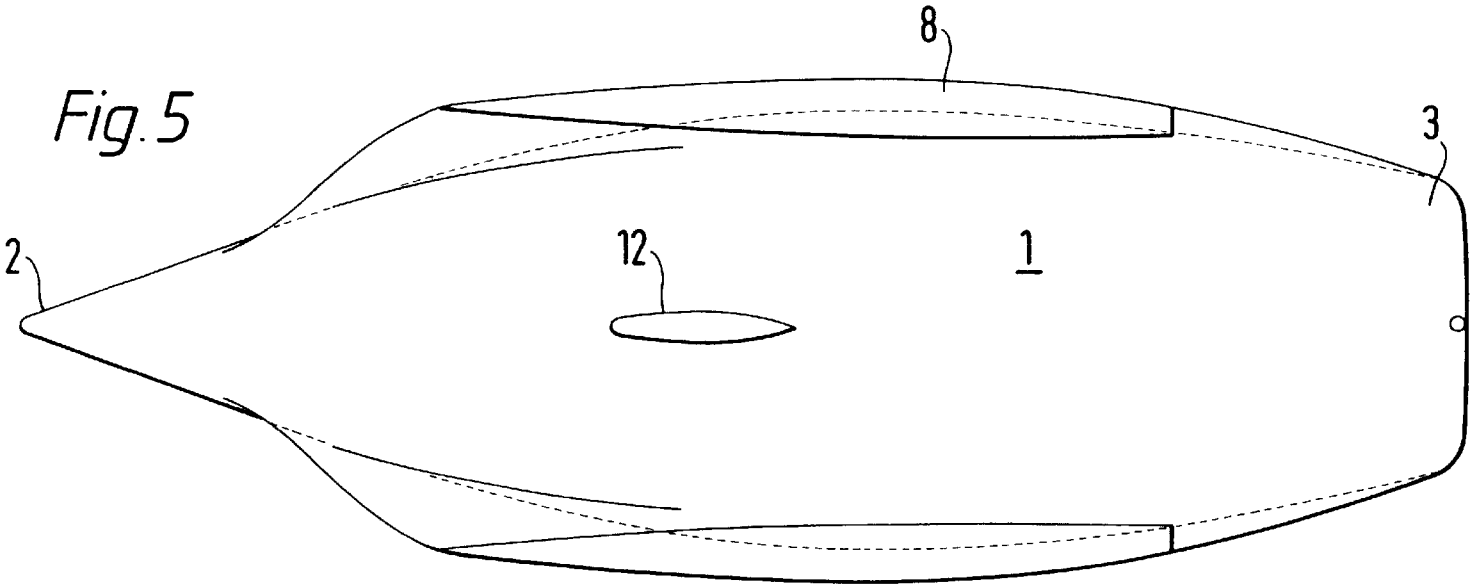

The arrangement of FIGS. 4 to 6 is generally similar to that of FIGS. 1 to 3 above, but here the pods 8 extend downwardly from the sides 33 of the main hull from a position 11 below the deckline of the main hull. The main hull 1 is formed with a fin keel 12.

Figure 9:
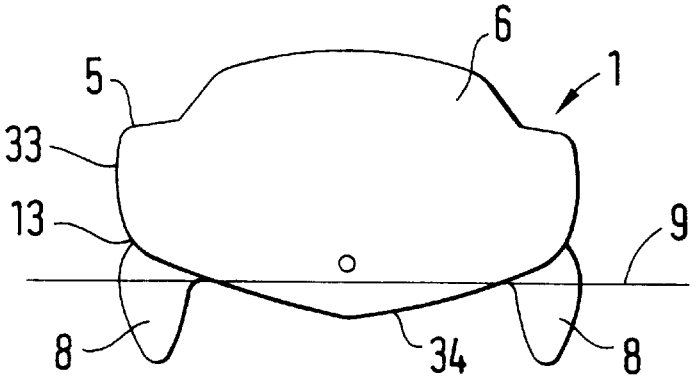
FIGS. 7 to 9 are generally similar to FIGS. 1 to 3 respectively and show a third embodiment of the invention.
Figure 7:
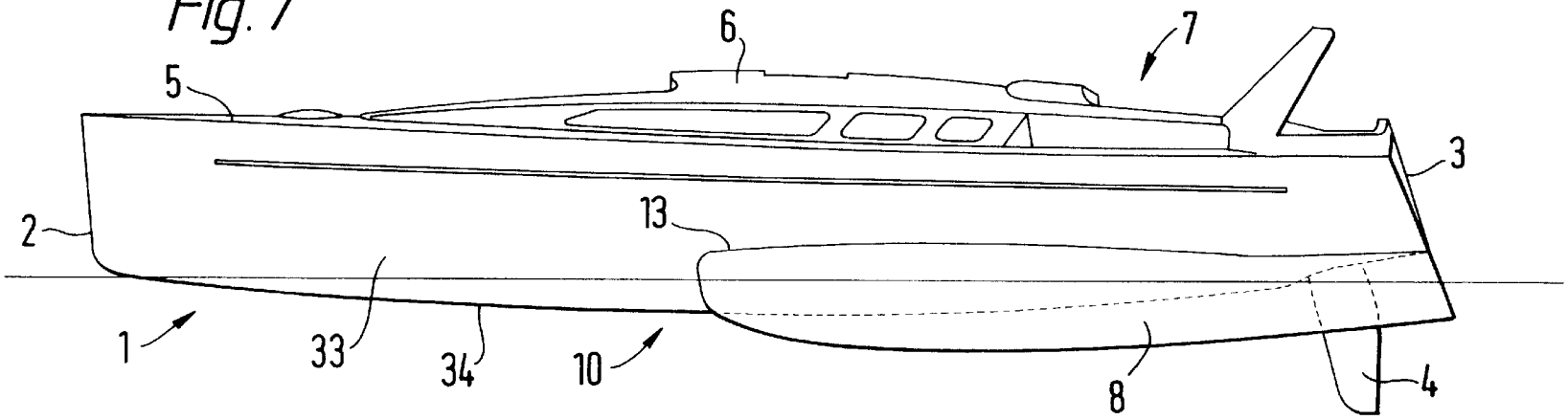
Figure 8:
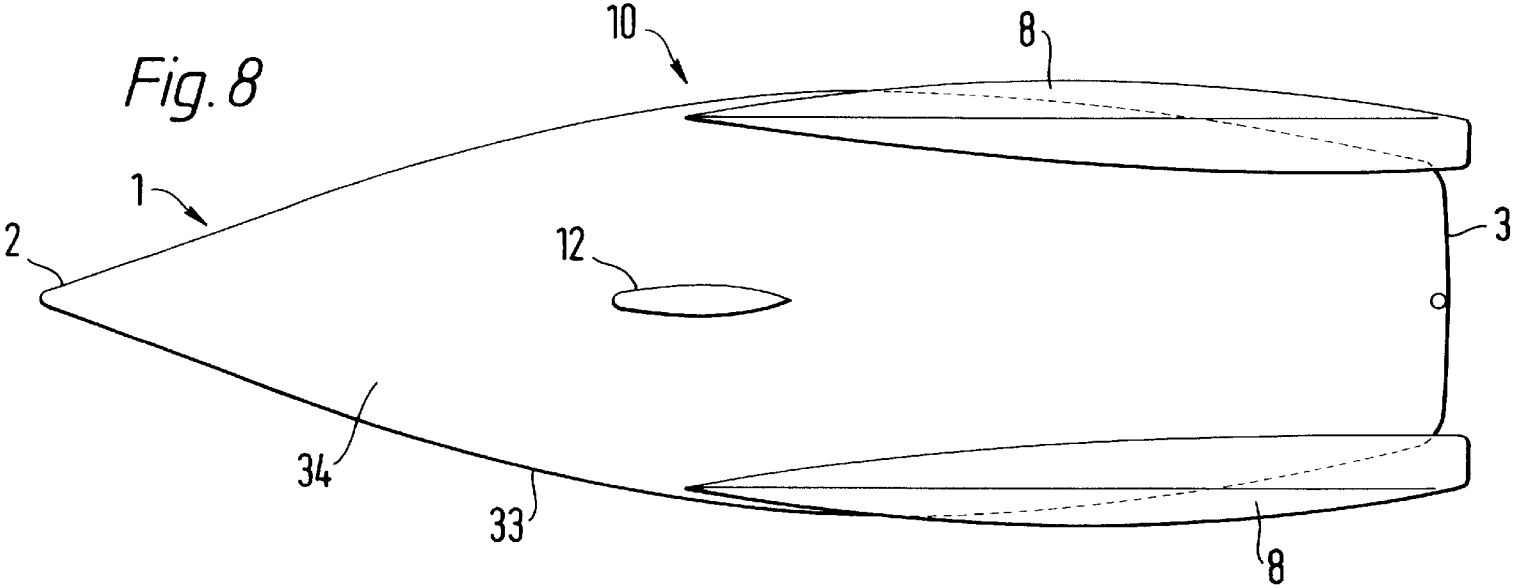

In FIGS. 7 to 9 there is shown a monohull pleasure craft convertible for use as a sail boat and as a power boat and having a main hull portion 1 having a bow 2, a stern 3, sides 33 and a bottom or underside 34. A steering rudder 4 is disposed at the stern 3. The craft has a deck 5 and a superstructure 6 and rear cockpit 7. The craft is also provided with a mast and sails (not shown) in conventional manner.

The opposite sides 33 of the hull 1 are formed with a pair of laterally extending stabilizing pods 8 which are integral with the hull 1 and which extend lengthwise of the main hull.

The main hull may be formed with devices or means for increasing lateral resistance to improve windward performance, e.g. a fin keel, centre board, centre plate, power thruster or the like (not shown). Alternatively or additionally such devices or means, e.g. fixed or retractable fin keels, dagger or lee boards or blades may be provided on the pods 8 to increase lateral resistance. Such devices, if retractable, may be made differentially retractable e.g. as an aid to steering, stability, performance and/or to provide active ballast, see FIG. 14.

The pods 8 are buoyant to increase the stability of the craft. Propulsion units and their associated fuel tanks, along with other heavy equipment such as electrical batteries, generators and water tanks can be accommodated in the pods so that they do not occupy or intrude into the usable accommodation space in the main hull and so that the propulsion units etc. provide optimally distributed ballast positioned remote from the centre line of the craft, i.e. at or near to the beam extremities, to increase inertia about the longitudinal axis of the craft and thereby reduce roll angle. Also noise and smell associated with engines may be reduced by disposing the propulsion units etc. in the pods. The propulsion units may be coupled to drive propellers but they may be in the form of water jet propulsion units, i.e. hydrojets.

The interiors of the pods 8 are preferably physically separate from the interior of the main hull portion, although they may be connected if desired e.g. by water-tight doors, not shown.

The craft may have both pods in the water when static although during normal operation one or other pod may be clear of the water, e.g. when the boat is heeled over. The craft may also operate in displacement, semi-displacement and/or planing modes.

The arrangement of FIGS. 7 to 9 is generally similar to those of FIGS. 1 to 6, but here the pods 8 are disposed further aft to extend from a mid position 10 of the hull to a position close to the stern 3 of the hull 1. Such an arrangement facilitates the housing of propulsion means in the pods and facilitates further adaptation, see the embodiments of FIGS. 20 to 34 below. Also the pods are positioned to extend from the sides 33 of the main hull from a position 13 relatively close to the water line 9.

In this embodiment, the pods rejoin the hull at a position on the bottom or underside 34 of the main hull portion 1 close to the waterline 9, as will be seen from FIG. 9. To some extent, the pods 8 thus resemble bilge keels and may be shaped to have the function of providing dynamic stability.

Figure 12:
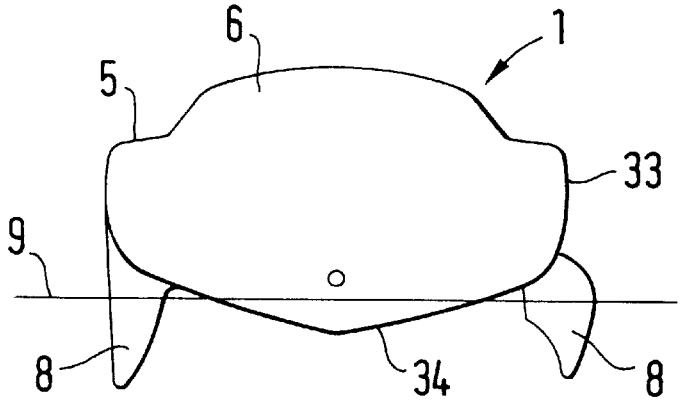
FIGS. 10 to 12 are respectively a side view, an underneath plan view and an end view of a fourth embodiment of craft in accordance with the invention.
Figure 10:
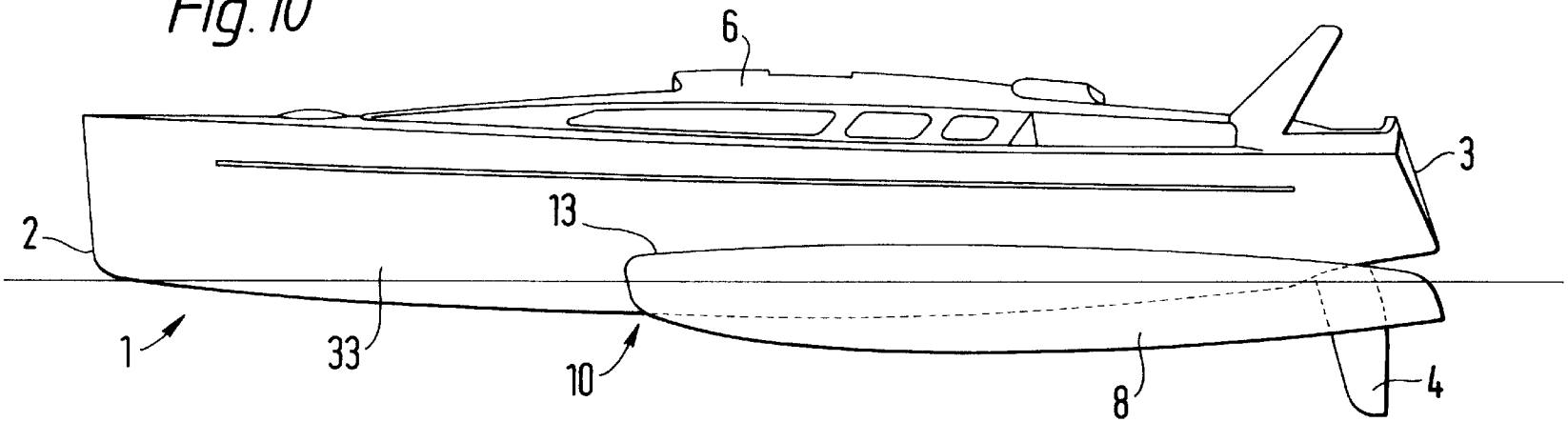
Figure 11:
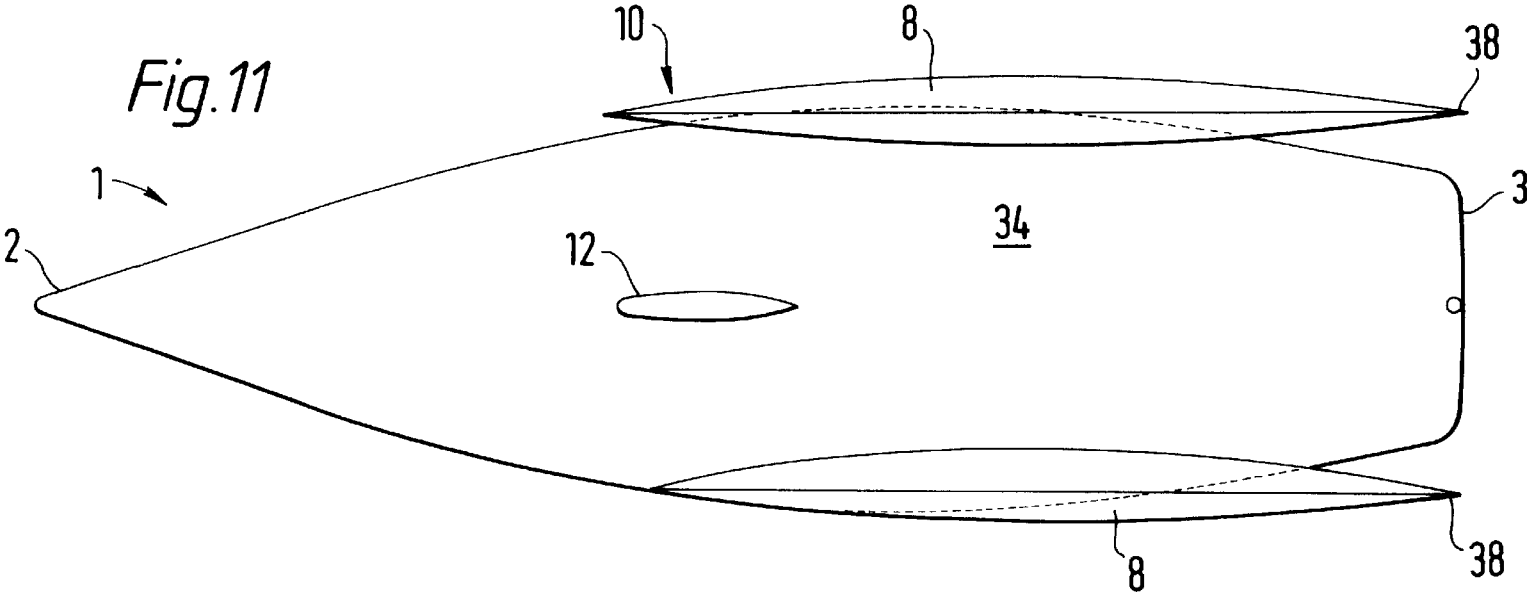

FIGS. 10 to 12 of the drawings show one example of craft similar to that of FIGS. 7 to 9 but intended purely as a sail boat so that the pods 8 are not arranged to house propulsion means. For this reason the stern portions 38 of the pods 8 are of canoe form, that is to say streamlined, to reduce resistance. The left-hand side of the craft shown in FIGS. 11 and 12 shows one possible pod form and the right hand side another possible pod form for use in such circumstances.

FIG. 13 shows typical theoretical curves of righting moments for three different hull shapes.

In FIG. 13 G=centre of gravity

B=centre of buoyancy at 30° of heel

M=metacentric height.

The distance from G to Z gives the righting lever, shown by curve 14 for a round bilge hull 19, by curve 15 for a conventional fuller bilge hull 19*a*, and by curve 16 for a hull 17 in accordance with the present invention showing its superiority at 30° of heel.

In FIG. 14, a craft in accordance with the invention is shown at 17 and a generally conventional monohull is shown at 19*b*. The conventional hull 19*b* is formed with a keel 21 carrying at its distal end a bulb ballast weight 35. The opposed vertical arrows Z' indicate righting forces acting on the craft 19*b*. In the craft 17 of the present invention, the pods 8 are provided with differentially retractable fin keels 36 formed at their distal ends with relatively small bulb ballast weights 35'. In the drawings one keel 36 is shown extended and the other retracted to increase the righting moment as indicated by arrows Z". Such an arrangement may be desirable to improve the performance of a craft according to the invention at high heel angles where a conventionally heavily keeled craft such as that shown at 19*b* tends to perform favourably as concerns righting moments.

FIG. 15 is a diagram showing the behaviour of a vessel 17 according to the present invention in a large beam sea 18, as compared to that of a round bilge hull 19 and a catamaran 20 and from which it will be seen that the behaviour of a craft according to the present invention may lie somewhere between that of a round bilge hull and that of a conventional catamaran. The drawing is diagrammatic and ignores dynamic effects under sail or power.

FIG. 16 compares how a round bilge monohull yacht 19 and a craft 17 according to the invention roll when static under the same conditions in a short beam sea 23, with the roll being sustained in the case of the monohull yacht 19 by the pendulum effect of its heavy ballast keel 21. The monohull of the present invention may perform better in such circumstances, at least as concerns passenger comfort, due to the absence or reduction of the keel pendulum effect.

FIG. 17 is a diagram showing the hull outlines in plan (wide shaded areas 24) and immersed areas (fine shaded areas 25), i.e. water plane sections or footprints, of various different craft. At 17 there is shown an embodiment of a vessel according to the present invention, at 19 a conventional monohull, at 20 a typical catamaran and at 37 a typical trimaran. These outlines and footprints are shown in a static condition, i.e. when the vessels are stationary. It will be seen that a vessel 17 of the present invention may have three distinct water plane sections 25 under static conditions.

However as shown in FIG. 18 when laden the three footprints may merge as indicated at A to form a single footprint. When heeled over, one of the pods may be above water level as shown at B, and at speed the main hull may be lifted substantially or entirely from the water as shown at C. At D there is shown a modified version of diagram C with the main hull substantially lifted so that only the bow region 28 of the main hull portion contacts the water whereby the craft is supported on a tripod consisting of the pair of pods 8 and the bow region 28 of the main hull portion somewhat in the manner of a hydrofoil craft.

In FIGS. 19 to 34 there are shown embodiments of craft in accordance with the present invention and in which the pair of pods 8 are movable between positions as shown in full and dotted lines. The embodiments of FIGS. 19 and 20 may be particularly applicable to a sail yacht and the embodiments of FIGS. 21 to 34 may be more applicable to a power boat.

In the embodiment of FIG. 19 the pods can be retracted to be received in cavities 26 in the main hull portion so as to be flush with the outer surface of the sides 33 and bottom 34 of the hull. The retraction and extension may be achieved hydraulically or mechanically or by inflation. The pods 8 are hinged to the hull at their tops 22 about an axis extending longitudinally of the craft for movement in the direction of arrow W. The pods 8 may be separately movable to provide both active buoyancy and/or active ballast.

As can be seen from the embodiment of craft shown in FIG. 20, the pods are hinged on the main hull portion about pivots 31 having vertical axes for lateral movement as indicated by arrow Y and as shown in dotted lines.

FIGS. 21 to 24 and 29 to 31 show an embodiment of power boat which is a development of the embodiment of FIGS. 7 to 9 and in which the pods 8 are pivoted about pivots 29 near to their leading ends 30 on a common axis on the main hull portion at its mid position 10. The common axis of the pivots 29 is horizontal and extends laterally of the hull, whereby the pods can be moved up and down by power means (not shown) as indicated by arrow V to trim the craft.

FIGS. 21 to 23 show (under static conditions) how the pods 8 of the embodiment of FIGS. 29 to 31 can be moved upwards (see FIG. 23 arrow V") or downwards (see FIG. 22, arrow V') from the neutral position shown in FIG. 21 to trim the craft under different operating conditions. The pods may be differentially movable to adjust the attitude of the craft especially under power, e.g. to assist in manoeuvring, such as in tight turns. Where propulsion means are provided in the pods, it will be appreciated that vertical angling of the pods will cause a corresponding vertical thrust component from the propulsion means, which may be employed beneficially. The undersurfaces of the pods may be shaped to encourage dynamic lift and/or planing behaviour.

FIG. 24 is a perspective view of the power boat generally as shown in FIGS. 21 to 23 above and in which the pods 8 extend from a mid position 10 of the main hull portion 1 towards the rear of the main hull portion 1 and are disposed outwards of, and close to, the sides 33 of the main hull portion. The pods 8 extend below the bottom 34 of the main hull portion 1. The pods are pivotally connected to the main hull portion close to their forward ends 30 for vertical movement as indicated by arrows V and dotted lines. The dotted lines also indicate that the pods may be moved independently and in opposite directions.

The embodiment of power boat shown in FIG. 25 is generally similar to that shown in FIG. 24, but in this embodiment the undersurfaces 39 of the pods 8 are extended inwards towards the centre line 41 of the main hull portion to form generally horizontal wing or fin-like surfaces 40 which serve to increase the lift generated in motion of the boat. The wing or fin-like surfaces 40 may be received, at least in their uppermost positions, in correspondingly shaped cavities 26*a* in the underside of the main hull portion.

In the arrangement of FIG. 26, which is generally similar to that of FIG. 24, the stabilizing pods 8 are received in recesses 26*b* in the main hull portion so as to be disposed within the overall hull outline and are arranged for vertical movement in the recesses 26*b* as indicated by arrow V. The sides 33 of the main hull portion thus define the beam extremities.

The modified embodiment of power craft shown in FIGS. 27 and 28 is similar to that shown in FIG. 26, but, like the embodiment of FIG. 25, the pods 8 are extended inwardly at their undersides 39 to form generally horizontal wing or fin-like surfaces 40 received in cavities 26*a* in the underside of the main hull portion. As shown by arrow V in FIG. 27, the pods can move vertically. The arrow Y in FIG. 28 indicates that the pods are also laterally movable.

Figure 32:
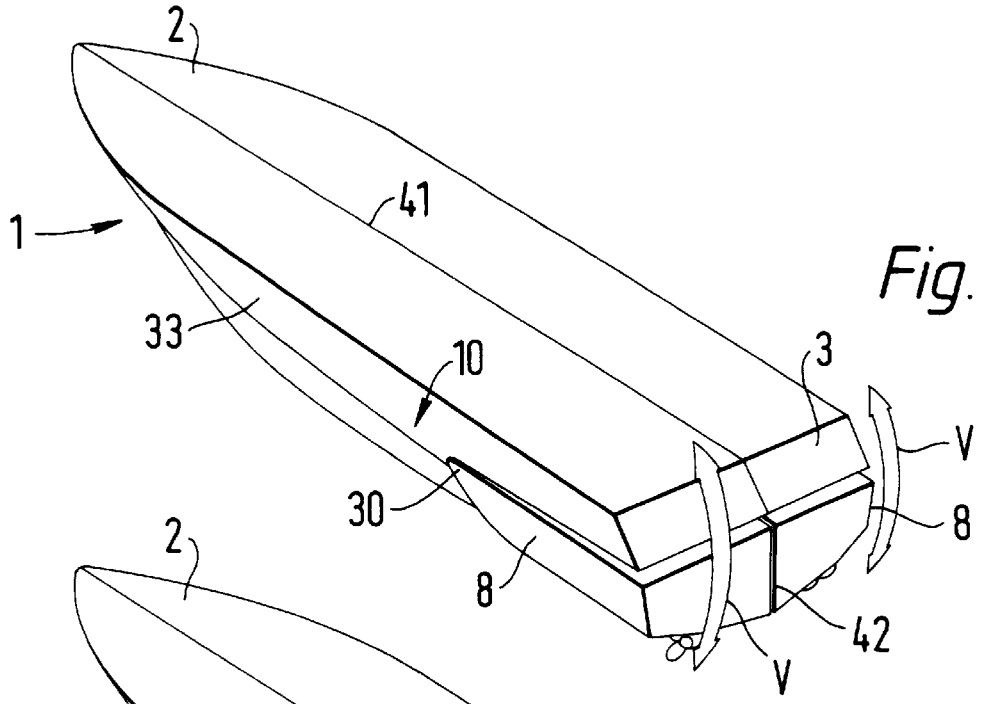
Figure 33:
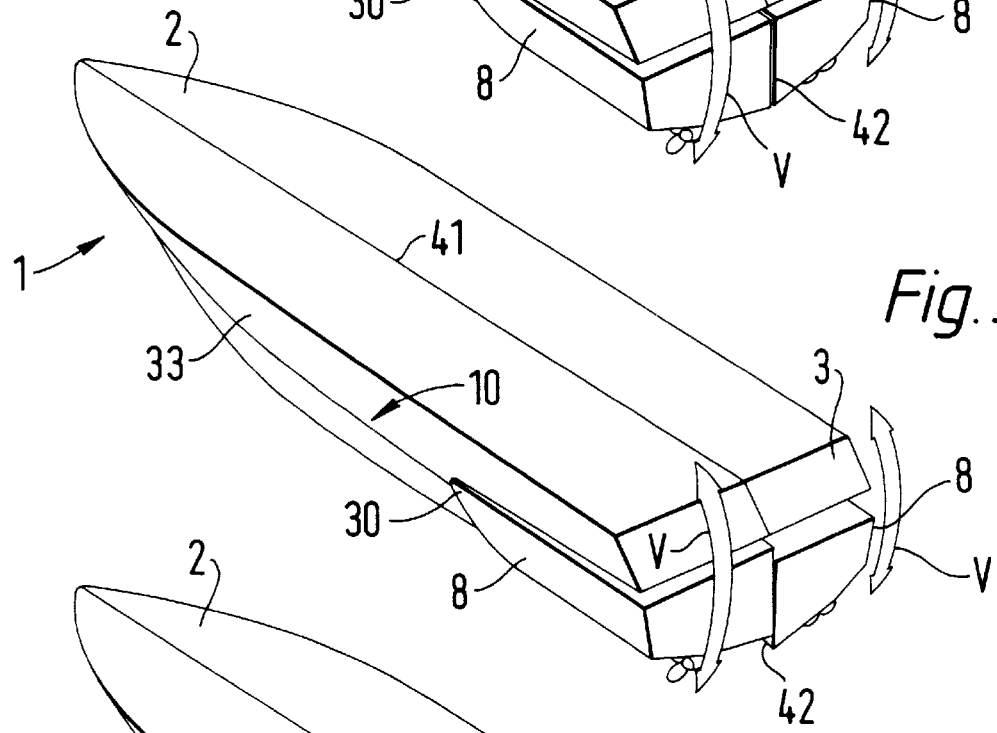
Figure 34:
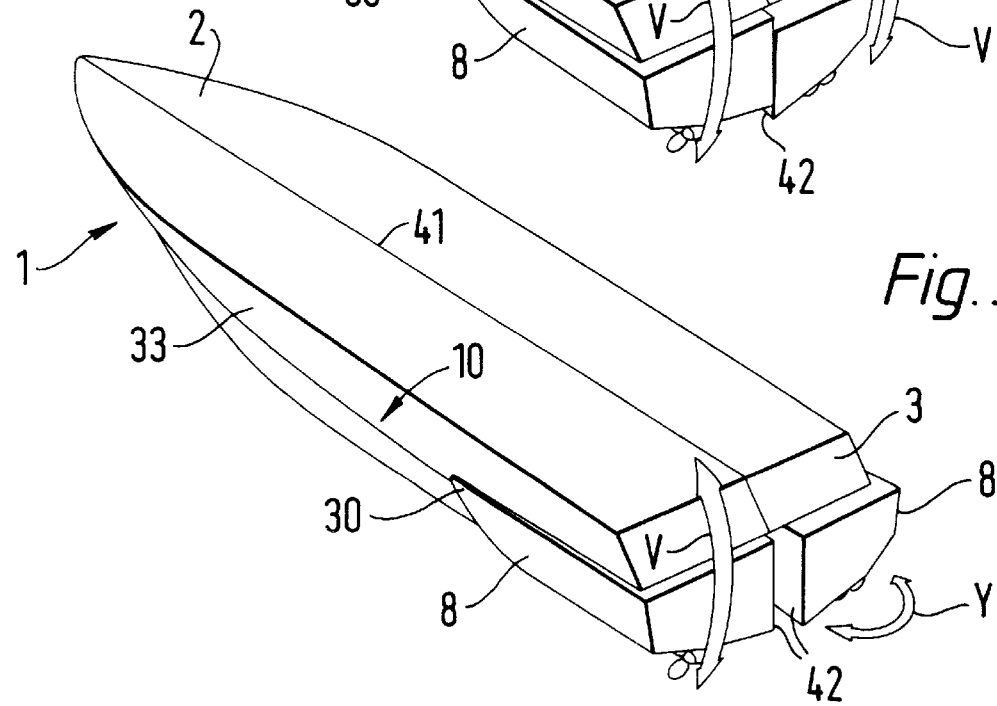

The arrangement of power boat shown in FIGS. 32 to 34 is similar to that of FIG. 26 but in this embodiment the stabilizers 8 are enlarged to extend laterally inwards so that their inner edges 42 are mutually adjacent and disposed close to the centre-line 41 of craft. The enlargement of the stabilizers will facilitate the installation of large, powerful propulsion means in the stabilizers. It will be seen that the stabilizers are movable vertically, see arrows V and/or horizontally, see arrow Y, about pivots (not shown) disposed near to the leading ends 30 of the stabilizers.

The retractable or movable pods shown in FIGS. 19 to 34 may be independently or differentially movable to improve the performance of the craft, e.g. by providing active ballast and/or active buoyancy, and/or steering.

With the embodiments of craft described above, at speed when the main hull is out of water, and whether the pods are in displacement, semi-displacement or planing mode, benefits may arise as follows:

In all three modes the total wetted area may be reduced.

In displacement mode the pods may improve hydrodynamic efficiency by presenting two long and narrow hulls to the water. This efficiency gain may partly be derived from favourable length to beam ratios. That is to say, should the main hull be immersed with the pods retracted, it will have a lower displacement hull speed than that of the pods for the same total resistance or transmitted power.

In planing mode the pods may produce their highest degree of hydrodynamic efficiency in terms of performance versus effort, in that the wetted area is reduced still further.

Semi-displacement may result in characteristics somewhere between displacement and planing modes and the precise behaviour will depend on design parameters, load factors, speed, sea/wind conditions and the like.

Under power with just the pods immersed, greater hydrodynamic efficiency may result in lowered fuel consumption. In addition the craft may tend to cut through the waves rather than ride on their surface, thereby significantly reducing pitching motions and enhancing passenger comfort.

Equally, the wide effective beam produced by the twin pods may also tend to resist roll motions enhancing passenger comfort. Again, the two slender pods behaving like a catamaran can act to reduce wave-making resistance.

Where the pods are movable the following benefits also apply:

Should the pods be buoyant and be projected incrementally downwards into the water, they may assist in correcting the squat effect produced under power.

Under power, the pods may be used in the same way as trim tabs to alter the attitude of the vessel to the flow of the water and assist in producing dynamic lift.

In addition where the pods have variable geometry to vary their orientation in the vertical and/or horizontal planes and incorporate propulsion units, they may facilitate the precise control of the thrust angle, to improve the transmission of power to water.

It is possible that movable stabilizers, for example, of the arrangement of FIGS. 19 to 34 could be made to behave analogously to the suspension of an automobile, e.g. by interposing resilient means e.g. springs and dampers. Alternatively the suspension may be active for example under the control of an intelligent control system such as a microprocessor, to improve the ride characteristics of the craft. Thus the pods could be subject to continuous adjustment, perhaps under the influence of dynamic feedback to counteract unpleasant, so-called "cork screwing" motion by moving the pods in equal and opposite senses to counteract both pitch and roll.

The benefits of the hull designs of the present invention may include the following:

1. The facilitation of convertibility between sail craft and power boat.
2. Enhanced safety in water-borne craft.
3. General improvements in convenience in water-borne craft.
4. The unitary or close coupled design of the main hull and the pods may improve the strength of the hull structure or at least makes it easier to achieve the required strength as compared to conventional multi-hull craft.
5. The close-coupled pods may be smaller than those of a catamaran since they do not each have to support the weight of the whole craft when the craft is heeled-over e.g. under sail. This is because with the hull design of the present invention, the main hull will assist in supporting the craft during such times since the main hull and the wetted pod can together form one contiguous buoyant volume.
6. The hull design of the present invention may permit improved or optimised weight distribution since much of the ballast, i.e. engines, fuel, etc. can be accommodated in the pods, i.e. near to the beam extremities. This also improves stability and roll resistance.
7. The hull design of the present invention may provide an opportunity for the use of twin propulsion units without intruding into usable space within the main hull. Unlike a conventional monohull craft, the propulsion units can be set far apart. This in turn can improve manoeuvring at low speed. The use of twin engines provides some degree of redundancy in the event of one engine failure. The need for bow thrusters may also be removed or reduced.
8. The hull design of the present invention may allow at least some of the efficiencies of multi-hull craft while mitigating against the disadvantages of known multi-hull designs. Thus the effective waterline beam of the craft may be increased to improve roll resistance without an increase in wetted area. By careful distribution of ballast in the pods, pitching resistance may also be improved.
9. The invention may allow the substantial elimination of the need for a ballast keel when sailing while retaining advantages of a monohull. This may allow a large reduction in overall weight and may give the possibility of planing of the main hull or of the whole craft when under sail or power.
10. The invention may provide the advantage of good hydrodynamic shape approximating to that of a catamaran or trimaran even when in displacement mode.
11. The craft of the invention may provide improved behaviour compared to that of a multi-hull craft and approximating to that of a monohull craft with respect to its superior angle of vanishing stability when beam-on to wave and wind, under which conditions multi-hull craft can more readily tend to approach their point of vanishing stability.

12. The craft of the invention may allow reduced sail area for given performance approximating to that of a multi-hull design, and may improve fuel efficiency when under power at least partly due to the reduced or eliminated ballast keel.

13. The craft of the invention may provide the opportunity for the safer use of petrol engines since they and their fuel can be contained in the pods, i.e. isolated from the crew/passenger accommodation in the main hull. This also facilitates the jettisoning of fuel, e.g. petrol or gas tanks, under extreme conditions, and even the jettisoning of the pods themselves, e.g. with the aid of explosive bolts.

14. Where active ballast is employed, the ballast may be moved between the pods to increase the righting moment due to the distance between the pods.

15. The craft of the invention, when using independently movable pods, may enable the introduction of active buoyancy and/or active ballast.

16. The pods of the hull design of the present invention may provide a degree of side impact protection for the main hull. Also since the pods can extend downwards below the main hull, any submerged static or floating objects such as rocks or the like will tend to contact the pods rather than the main hull.

17. The hull design is preferably such that the craft remains buoyant with one or both pods holed or with the main hull holed. The safety of the craft is thus increased in comparison to a conventional monohull or a catamaran or trimaran.

18. Sea water inlets and/or outlets, e.g. for propulsion units, generators and air conditioning equipment may be arranged in the pods to reduce the need for sea cocks or valves in the main hull as an aid to reducing the danger of flooding and the discomfort and nuisance of leaks. The reduction of leaks and moisture will also facilitate the performance of electrical equipment and since this will usually include navigational and communication equipment, this can have a direct and positive effect on safety. Similarly, fuel inlets may be arranged in the pods in the interests of general cleanliness of the craft.

19. Especially where the pods are integral with the hull they may form a stable support for the craft on dry land, i.e. in the nature of bilge keels. The pods may also be shaped and used to provide roll stability to the craft in the way provided by conventional bilge keels.

20. By housing the propulsion means, fuel tanks etc, in the pods more accommodation room and cargo capacity is created in the main hull portion.

The novel craft shown in the drawings provide significant advances in the state of the art.

I claim:

1. A monohull water-bourne craft comprising:

a hull having a bow region and a stern region and connected by opposite sides running between said bow and stern regions;

a pair of buoyant stabilizers extending immediately adjacent and along said opposite sides of the hull such that under static unladen conditions the craft has three water plane sections or footprints;

the craft further comprising propulsion means, which propulsion means are located in said stabilizers.

2. A monohull water-borne craft according to claim 1, wherein said stabilizers are elongate and positioned with their longitudinal axes extending along the opposite sides of the hull.

3. A monohull water-borne craft according to claim 1, wherein the stabilizers extend laterally of said opposite sides of the hull.

4. A monohull water-borne craft according to claim 1, further comprising ballast means located in said stabilizers to enable ballast to be located remote from the centre line of the hull so as to provide stability to the craft.

5. A monohull water-borne craft according to claim 1, wherein the stabilizers are formed as pods.

6. A monohull water-borne craft according to claim 1, wherein the craft is at least substantially without a ballast keel as herein defined.

7. A monohull water-borne craft according to claim 1, further comprising sail means whereby the craft is convertible for use as a sail craft and as a power boat.

8. A monohull water-borne craft according to claim 1, wherein the stabilizers are formed integrally with the hull.

9. A monohull water-borne craft according to claim 1, further comprising connector means for connecting the stabilizers to the hull in a manner enabling the stabilizers to be moved relative to the hull.

10. A monohull water-borne craft according to claim 9, further comprising first power means operable to move the stabilizers and cavities in the surface of the hull for housing the stabilizers, the stabilizers being movable by operation of said power means between positions in which they extend laterally from the opposite sides of the hull to positions in which they lie substantially flush with surface of the hull.

11. A monohull water-borne craft according to claim 9, wherein the stabilizers have longitudinal axes and second power means are provided for moving the stabilizers relative to the hull to alter the angles of their longitudinal axes with respect to the longitudinal axis of the hull.

12. A monohull water-borne craft according to claim 11, further comprising pivot means operable to mount said stabilizers on the hull such that said stabilizers are movable in a plane having a vertical component.

13. A monohull water-borne craft according to claim 11, further comprising pivot means operable to mount said stabilizers on the hull such that said stabilizers are movable in a plane having a horizontal component.

14. A monohull water-borne craft according to claim 11, wherein the stabilizers having leading ends and the craft further comprises pivot means disposed at said leading ends of said stabilizers.

15. A monohull water-borne craft according to claim 9, wherein said stabilizers are inflatable and wherein the craft further comprises means for inflating the stabilizers.

16. A monohull water-borne craft according to claim 9, further comprising power means connected to each of said stabilizers thereby enabling said stabilizers to be independently moved.

17. A monohull water-borne craft according to claim 1, wherein the hull and the stabilizers comprise external surfaces and wherein the external surfaces of the hull and the stabilizers merge smoothly together.

18. A monohull water-borne craft according to claim 1, wherein the stabilizers are narrow in width in relation to their length.

19. A monohull water-borne craft according to claim 5, wherein the stabilizers are formed as bulges extending from said opposite sides of the hull.

20. A monohull water-borne craft according to claim 1, wherein the stabilizers are formed as enclosures which are separate from the interior of the hull.

21. A monohull water-borne craft according to claim 17, wherein the stabilizers are formed with upper and lower portions and wherein said upper portions of the stabilizers are directly connected to the hull.

22. A monohull water-borne craft according to claim 1, wherein the stabilizers are formed with upper and lower portions and project downwardly from the hull.

23. A monohull water-borne craft according to claim 22, wherein the downward projection of the stabilizers is substantially vertical.

24. A monohull water-borne craft according to claim 23, wherein the stabilizers project downwardly to an extent that their lower portions extend below the hull.

25. A monohull water-borne craft according to claim 1, wherein the stabilizers join the hull near to the waterline of the hull.

26. A monohull water-borne craft according to claim 1, wherein the hull comprises a deckline and wherein the stabilizers extend to the deckline of the hull.

27. A monohull water-borne craft according to claim 1, wherein the hull has opposite sides and wherein said stabilizers extend along said opposite sides of the hull from a position near to the bow region of the hull to a position near to the stern region of the hull.

28. A monohull water-borne craft according to claim 1, wherein the hull has a mid region between said bow and stern regions, and wherein said stabilizers extend from said mid region of the hull to a position adjacent to the stern region of the hull.

29. A monohull water-borne craft according to claim 1, further comprising lateral stability enhancing devices formed on the stabilizers.

30. A monohull water-borne craft according to claim 1, further comprising rudders on said stabilizers.

31. A monohull water-borne craft according to claim 4, wherein said ballast means in each of said stabilizers comprises a member of the group consisting of a fuel tank, a water tank, an electrical battery, and an electrical generator.

32. A monohull water-borne craft according to claim 4, wherein active ballast tanks are located in the stabilizers.

33. A monohull water-borne craft according to claim 9, further comprising means operable to enable said stabilizers to be jettisoned.

34. A monohull water-borne craft according to claim 9, wherein the stabilizers are shaped to create hydrodynamic lift.

35. A monohull water-borne craft according to claim 9, wherein the stabilizers comprise wing-like portions which extend inwardly below the hull.

36. A monohull water-borne craft according to claim 9, wherein recesses are provided in the hull in which recesses the stabilizers are at least partly receivable.

37. A convertible monohull water-borne craft adapted for use as a sail craft and as a power craft, the craft comprising:

a hull having a bow region and a stern region and connected by opposite sides running between said bow and stern regions;

a pair of buoyant stabilizers extending immediately adjacent and along said opposite sides of the hull immediately adjacent said hull such that under static unladen conditions the craft has three water plane sections or footprints;

the craft further comprising propulsion means, which propulsion means are located in said stabilizers, and wherein said craft is at least substantially without a ballast keel.

38. A monohull water-bourne craft comprising a hull with a bow region and a stern region and opposite sides running between said bow and stern regions and defining a pair of beam extremities, a pair of buoyant stabilizers provided to extend along said opposite sides of the hull immediately adjacent said hull such that under static unladen conditions the craft has three water plane sections or footprints, and a pair of propulsion means for the craft are provided one of which propulsion means is located near to one of said beam extremities and the other of which propulsion means is located near to the other one of said beam extremities.

39. A monohull water-borne craft according to claim 28, wherein the craft is at least substantially without a ballast keel as herein defined.

40. A monohull water-borne craft according to claim 38, wherein the stabilizers are buoyant.

41. A monohull water-borne craft according to claim 38, wherein the stabilizers extend downwardly below the hull.

42. A monohull water-borne craft according to claim 38, wherein the craft is a sail craft.

43. A monohull sail craft according to claim 42, wherein the pair of propulsion means are hydrojet propulsion means housed in the respective stabilizers.

44. A monohull water-borne craft according to claim 38, wherein the stabilizers are ballasted.

45. A monohull water-borne craft according to claim 38, comprising a retractable keel in each stabilizer.

46. A monohull water-borne craft according to claim 38, further comprising pivot means mounting the stabilizers on the hull and means operable to move the stabilizers relative to the hull and relative to one another.

47. A monohull water-borne craft according to claim 46, further comprising at least one recess in the surface of the hull said opposed pair of elongate stabilizers being at least partly housed in said at least one recess.

* * * * *

UNITED STATES PATENT AND TRADEMARK OFFICE

CERTIFICATE OF CORRECTION

PATENT NO. : 5,937,777

DATED : August 17, 1999

INVENTOR(S) : Farad AZIMA

Figure 13A:
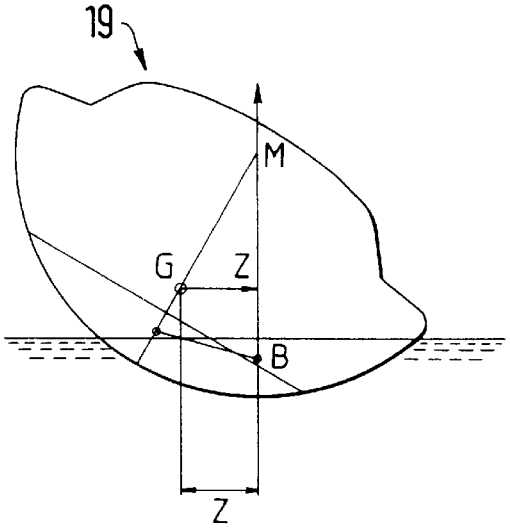
FIG. 13 is a diagram indicative of righting moments of different monohull designs.
Figure 13B:
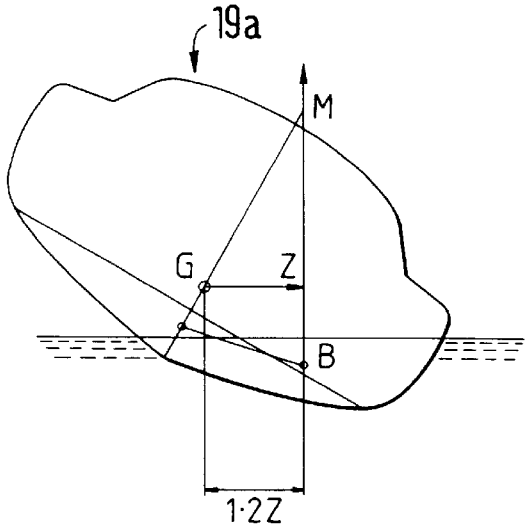
Figure 13C:
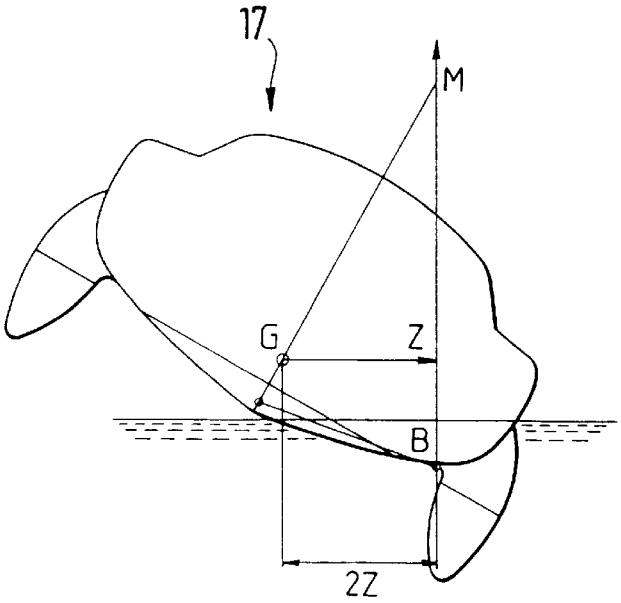

It is certified that error appears in the above-identified patent and that said Letters Patent is hereby corrected as shown below:

Column 4, line 33 replace "Figure 13 is a diagram" with --Figures 13A, B and C are diagrams--.

Figure 13D:
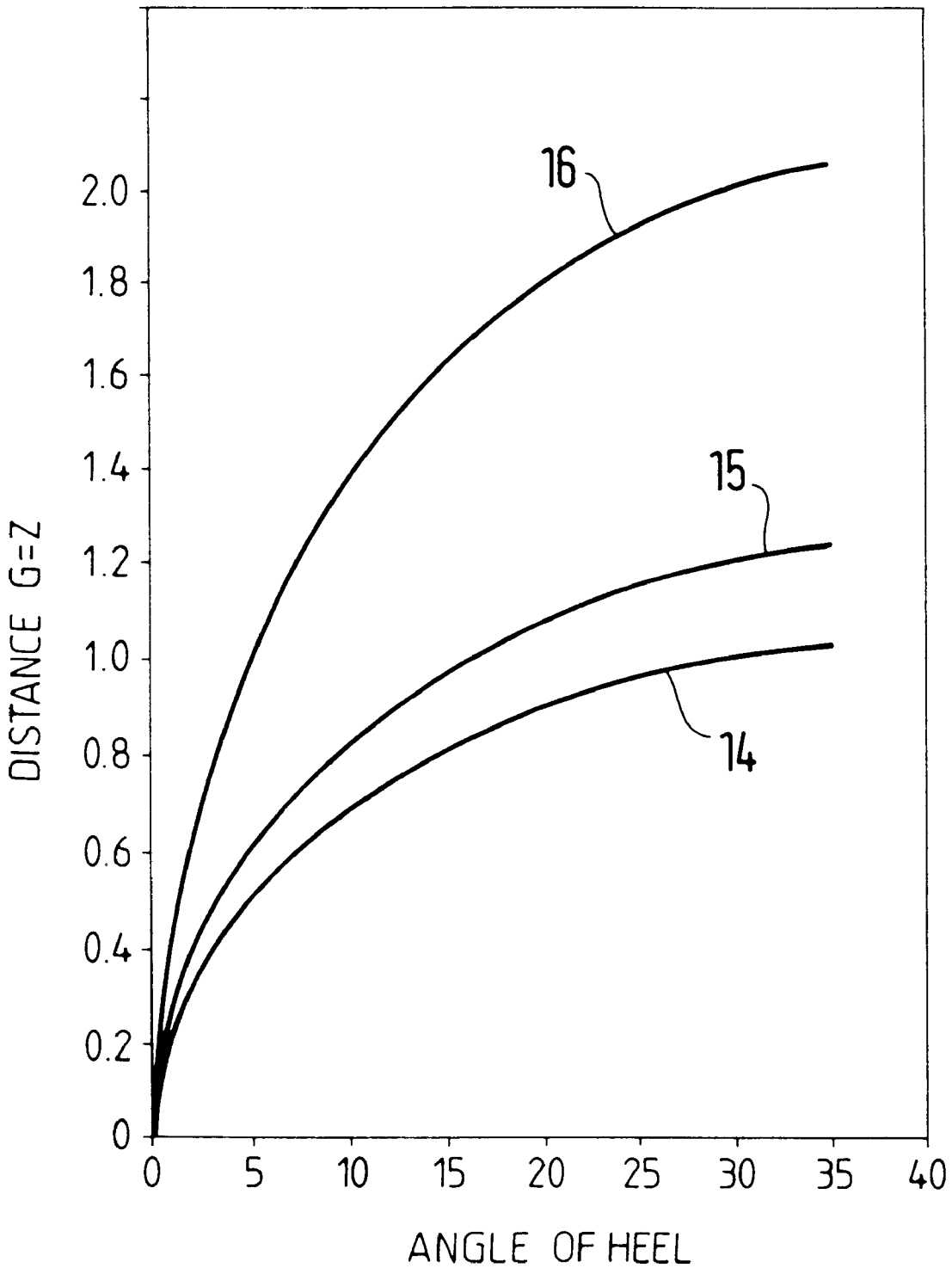

Column 4, after line 34 insert --Figure 13D is a graph of the Distance G=Z vs Angle of Heel;--.

Column 4, line 40 replace "Figure 16 is a diagram" with --Figures 16A and B are diagrams--.

Figure 17C:
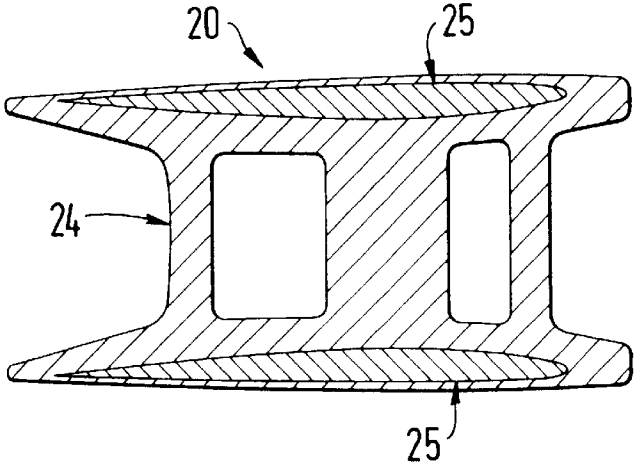
Figure 17D:
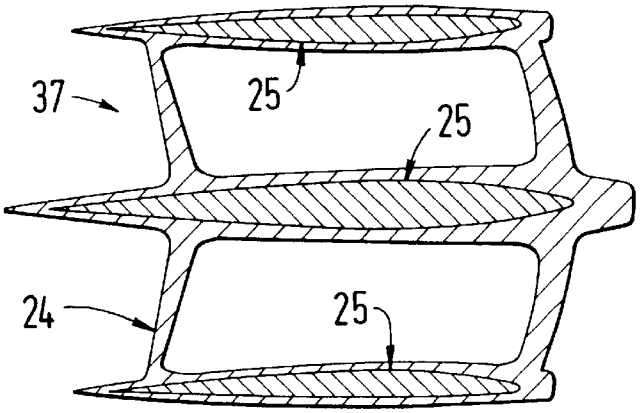
Figure 17A:
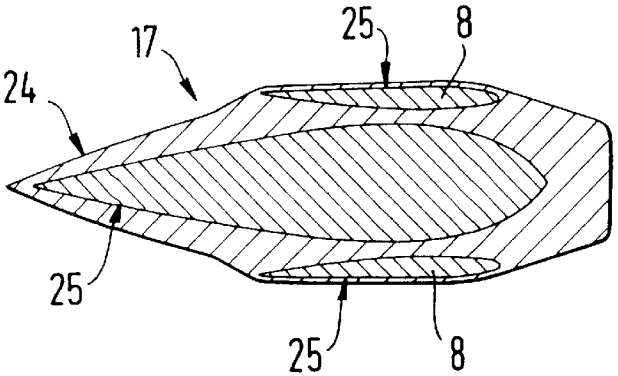
Figure 17B:
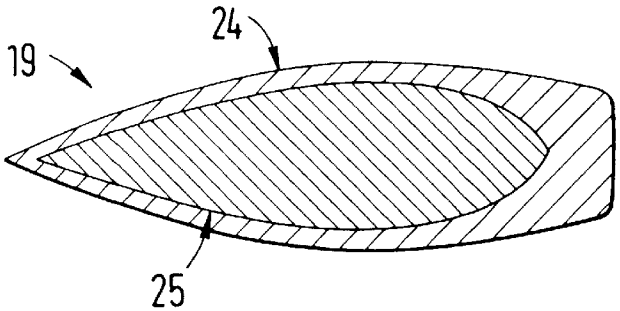

Column 4, line 44 replace "Figure 17 is a diagram" with --Figures 17A, B, C and D are diagrams--.

Figure 18B:
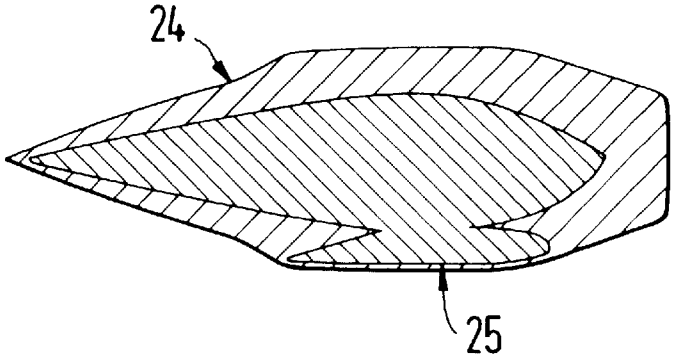
Figure 18D:
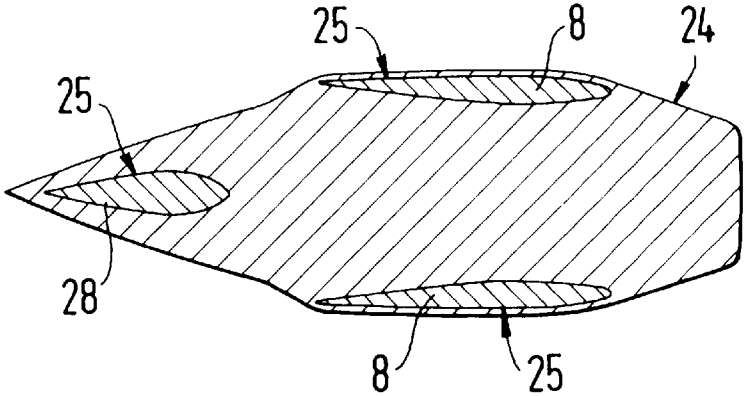
Figure 18A:
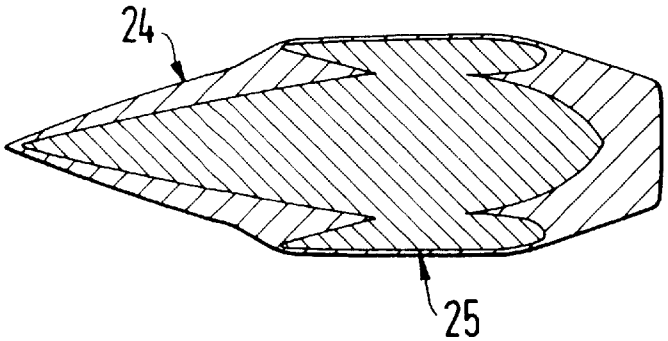

Column 4, line 48 replace "Figure 18 is a diagram" with --Figures 18A, B, C and D are diagrams--.

Column 4, line 50 replace "Figure 17" with --Figures 17A, B, C and D--.

Column 5, line 46 replace "14" with --14A--.

Column 7, line 9 replace "13" with --13D--.

UNITED STATES PATENT AND TRADEMARK OFFICE

CERTIFICATE OF CORRECTION

PATENT NO. :5,937,777

DATED :August 17, 1999

INVENTOR(S) :Farad AZIMA

It is certified that error appears in the above-identified patent and that said Letters Patent is hereby corrected as shown below:

Column 7, line 11 replace "Figure 13" with --Figures 13A, B, C and D--.

Column 7, line 43 replace "Figure 16 compares" with --Figures 16A and B compare--.

Column 7, line 51 replace "Figure 17 is a diagram" with --Figure 17A, B, C and D are diagrams--.

Column 7, line 61 replace "Figure 18" with --Figures 18A, B, C and D--.

Column 7, line 62 replace "at A" with --in Figure 18A--.

Column 7, line 64 replace "at B" with --in Figure 18B--.

Figure 18C:
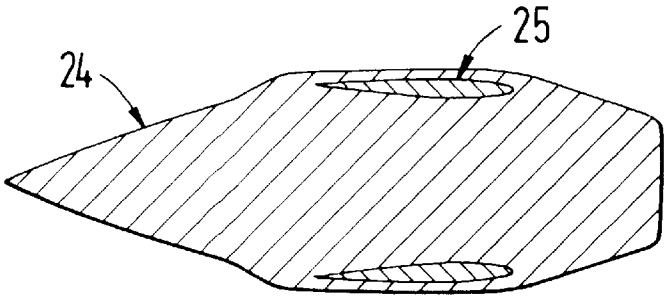

Column 7, line 66 replace "at C" with --in Figure 18C--.

Column 7, line 66 replace "at D" with --in Figure 18D--.

Column 7, line 66 replace "diagram C" with --Figure 18C--.

UNITED STATES PATENT AND TRADEMARK OFFICE

CERTIFICATE OF CORRECTION

PATENT NO. : 5,937,777

DATED : August 17, 1999

INVENTOR(S) : Farad AZIMA

It is certified that error appears in the above-identified patent and that said Letters Patent is hereby corrected as shown below:

Column 13, claim 24, line 14 replace "23" with --22--,

Column 14, claim 39, line 29 replace "28" with --38--,

Signed and Sealed this

Fourteenth Day of March, 2000

*Attest:*

*Attesting Officer*

Q. TODD DICKINSON

*Commissioner of Patents and Trademarks*